US011364537B2

(12) United States Patent
Hanai et al.

(10) Patent No.: US 11,364,537 B2
(45) Date of Patent: Jun. 21, 2022

(54) METHOD AND FLASKLESS MOLDING LINE FOR REDUCING MOLD SHIFT OF COPE AND DRAG THAT HAVE BEEN MOLDED BY FLASKLESS MOLDING MACHINE AND ASSEMBLED

(71) Applicant: Sintokogio, Ltd., Aichi (JP)

(72) Inventors: Takashi Hanai, Aichi (JP); Takehiro Sugino, Aichi (JP)

(73) Assignee: SINTOKOGIO, LTD., Aichi (JP)

( * ) Notice: Subject to any disclaimer, the term of this patent is extended or adjusted under 35 U.S.C. 154(b) by 0 days.

(21) Appl. No.: 16/756,093

(22) PCT Filed: Jul. 12, 2018

(86) PCT No.: PCT/JP2018/026282
§ 371 (c)(1),
(2) Date: Apr. 14, 2020

(87) PCT Pub. No.: WO2019/077818
PCT Pub. Date: Apr. 25, 2019

(65) Prior Publication Data

US 2021/0187598 A1 Jun. 24, 2021

(30) Foreign Application Priority Data

Oct. 19, 2017 (JP) ..... JP2017-202337

(51) Int. Cl.
*B22C 19/04* (2006.01)
*B22C 11/10* (2006.01)
(Continued)

(52) U.S. Cl.
CPC ..... *B22C 19/04* (2013.01); *B22C 11/08* (2013.01); *B22C 11/10* (2013.01); *B22C 15/02* (2013.01); *B22C 25/00* (2013.01)

(58) Field of Classification Search
CPC ..... B22C 19/04; B22C 21/10; B22C 11/00; B22C 11/08; B22C 11/10; B22C 15/02; B22C 25/00
See application file for complete search history.

(56) References Cited

U.S. PATENT DOCUMENTS 3,556,196 A * 1/1971 Eugen ..... B22C 11/10 164/38
4,724,886 A 2/1988 Sjodahl
2018/0326475 A1* 11/2018 Sakai ..... B22C 19/04

FOREIGN PATENT DOCUMENTS

CN 107848023 A 3/2018
EP 2777844 A1 * 9/2014 ..... B22C 11/00
(Continued)

OTHER PUBLICATIONS

International Search Report for PCT/JP2018/026282 dated Aug. 14, 2018.
(Continued)

*Primary Examiner* — Kevin P Kerns
*Assistant Examiner* — Steven S Ha
(74) *Attorney, Agent, or Firm* — Finnegan, Henderson, Farabow, Garrett & Dunner, LLP

(57) ABSTRACT

Providing a method for reducing occurrences of a mold shift of a cope and a drag that have been molded by a flaskless molding machine and have been assembled by estimating a cause of a mold shift based on measurements and by taking appropriate measures, and a flaskless molding line that uses the method. The method for reducing occurrences of a mold shift of a cope and a drag (1, 2) that have been molded by a flaskless molding machine (200) and have been assembled comprises a step of measuring specific data at positions where a mold shift may occur during a process for manufacturing or taking out the cope and the drag, and a step of
(Continued)

determining if the obtained specific data are within an allowable range.

12 Claims, 28 Drawing Sheets

(51) Int. Cl.

| | |
|---|---|
| ***B22C 11/08*** | (2006.01) |
| ***B22C 15/02*** | (2006.01) |
| ***B22C 25/00*** | (2006.01) |

(56) References Cited

FOREIGN PATENT DOCUMENTS

| | | | | |
|---|---|---|---|---|
| JP | H 04181003 | A | 6/1992 | |
| JP | 2772859 | B2 | 7/1998 | |
| JP | 2002-028754 | A | 1/2002 | |
| JP | 2013-25255 | A | 12/2013 | |
| WO | WO 2016/193790 | A1 | 12/2016 | |
| WO | WO 2017/122510 | A1 | 7/2017 | |
| WO | WO-2017122510 | A1 * | 7/2017 | ..... B22C 9/00 |

OTHER PUBLICATIONS

Office Action in corresponding Application No. JP 2017-202337 dated Aug. 11, 2020.

* cited by examiner

METHOD AND FLASKLESS MOLDING LINE FOR REDUCING MOLD SHIFT OF COPE AND DRAG THAT HAVE BEEN MOLDED BY FLASKLESS MOLDING MACHINE AND ASSEMBLED

TECHNICAL FIELD

The present invention relates to a method and a flaskless molding line for reducing a mold shift of a cope and a drag that have been molded by a flaskless molding machine and have been assembled.

BACKGROUND ART

A conventional flaskless molding machine has been publicly disclosed by which, after a cope and a drag have been simultaneously molded, they are assembled. Then they are stripped from an upper flask and a lower flask so that only the cope and drag are taken out from the molding machine (for example, see Patent Literature 1).

In a flaskless molding line that has such a flaskless molding machine a mold shift of a cope and a drag may occur when operating the line. Conventionally, an operator determines a cause of the mold shift each time a mold shift occurs. Thus, there have been problems, such as a long time being spent for determining the cause or no proper action being taken when the cause is not known.

The present invention was conceived in view of the above problems. The objectives of it are to provide a method for reducing the occurrences of a mold shift of a cope and a drag by estimating the cause of the mold shift based on measurements to take a proper action, and a flaskless molding line that uses that method.

PRIOR-ART PUBLICATION

Patent Literature
[Patent Literature 1]
Japanese Patent No. 2772859

SUMMARY OF INVENTION

To achieve the above-mentioned objects, a method of a first aspect of the present invention, for example, as in FIGS. 1, 3, 14, and 15, for reducing occurrences of a mold shift of a cope 1 and a drag 2 that have been molded by a flaskless molding machine 200 and have been assembled, comprises a step of taking measurements to obtain specific data at positions where a mold shift may occur during a process for manufacturing or taking out the cope 1 and the drag 2. It also comprises a step of determining if the obtained specific data are within an allowable range.

By the above configuration, since the cause of the mold shift is quantitatively estimated based on the specific data obtained at positions where a mold shift may occur to see if the specific data are within an allowable range, a proper action can be taken to reduce the occurrences of a mold shift of a cope and a drag. Here, the "positions where a mold shift may occur" is a position where some operation is carried out during a process for manufacturing or taking out the cope and the drag, such as molding a cope and a drag or transporting a cope and a drag. It denotes a route for transporting a cope and a drag, a means for operating on them, etc. The "specific data obtained at positions where a mold shift may occur" are data that relate to the cause of a mold shift on the route or the means, such as data on adhesion of dirt, an acceleration of means for transporting the cope and drag, etc.

The method of a second aspect of the present invention further comprises, for example, as in FIGS. 14 and 15, a step of determining if a mold shift of a cope and a drag has occurred. By this configuration, a relationship between a comparison of the obtained specific data with the allowable range, and the determination on an occurrence of a mold shift, can be found.

The method of a third aspect of the present invention further comprises, for example, as in FIG. 14, a step of modifying the allowable range for the specific data based on the determination on an occurrence of a mold shift. By this configuration, since the allowable range for the specific data is modified based on the determination on an occurrence of a mold shift, the allowable range can be optimized.

The method of a fourth aspect of the present invention further comprises, for example, as in FIG. 15, a step of preventing a mold shift by using the obtained specific data and the allowable range that has been modified by the step of modifying the allowable range. By this configuration, since the step of preventing a mold shift is carried out by using the optimized allowable range, a mold shift can be prevented from occurring.

By the method of a fifth aspect of the present invention, for example, as in FIG. 16, the step of modifying the allowable range or the step of preventing a mold shift is selectively carried out. By this configuration, the allowable range is optimized at the step of modifying the allowable range and a mold shift is prevented at the step of preventing a mold shift.

By the method of a sixth aspect of the present invention, for example, as in FIG. 16, shifting from the step of modifying the allowable range to the step of preventing a mold shift is carried out based on a number of operations of the step of modifying the allowable range, a number of non-occurrences of a mold shift, or a defect ratio that is a ratio of a number of occurrences of a mold shift to a number of operations of the step of modifying the allowable range. By this configuration, since shifting from the step of modifying the allowable range to the step of preventing a mold shift is carried out based on the number of operations of the step of modifying the allowable range, the number of non-occurrences of a mold shift, or the defect ratio, shifting to the step of preventing a mold shift, is carried out when the allowable range is optimized.

By the method of a seventh aspect of the present invention, for example, as in FIG. 16, shifting from the step of preventing a mold shift to the step of modifying the allowable range is carried out based on a number of determinations finding that a mold shift has occurred in the step of determining if a mold shift has occurred although no cause for an occurrence of a mold shift exists in the step of preventing a mold shift, or based on a ratio of errors that is a ratio of a number of determinations finding that a mold shift has occurred in the step of determining if a mold shift has occurred although no cause for an occurrence of a mold shift exists in the step of preventing a mold shift to a number of operations of the step of preventing a mold shift. By this configuration, the allowable range that has been optimized in the step of modifying the allowable range is used. Shifting from the step of preventing a mold shift to the step of modifying the allowable range is carried out based on a number of determinations finding that a mold shift has occurred although no cause for an occurrence of a mold shift exists in the step of preventing a mold shift, or the ratio of errors. Thus, if the allowable range is not fully optimized, shifting to the step of modifying the allowable range can be carried out.

By the method of an eighth aspect of the present invention, for example, as in FIGS. 14 and 15, if the obtained specific data are determined to be outside the allowable range, an action to eliminate the cause of a mold shift is carried out. By this configuration, since the cause of a mold shift is preliminarily eliminated, a mold shift can be prevented.

By the method of a ninth aspect of the present invention, for example, as in FIGS. 1-8, the process for manufacturing or taking out the cope and the drag comprises a step of filling molding sand 290 in an upper flask 250 and a lower flask 240. It also comprises a step of squeezing the molding sand 290 that has been filled in the upper flask 250 and the lower flask 240 by an upper squeezing board (not shown) and a lower squeezing board 220. It also comprises a step of pushing out a cope 1 and a drag 2 that have been squeezed from the upper flask 250 and the lower flask 240 to a plate 210 for receiving the mold by means of a cylinder 230 for stripping a mold. It also comprises a step of pushing out the cope 1 and the drag 2 on the plate 210 for receiving the mold to a means 300 for transporting the cope 1 and the drag 2 by means of a cylinder 120 for pushing out a mold. The specific data are at least one kind of data on a size of fouling on the lower squeezing board 220, a difference between the temperature of the molding sand 290 to be filled and the temperature of the lower squeezing board 220, a size of fouling on the plate 210 for receiving the mold, an existence of fouling on the means 300 for transporting the cope and the drag, a waveform of a pressure or an electric current to drive the cylinder 120 for pushing out the mold, an impact that is applied to a pushing plate 122 by the cylinder 120 for pushing out the mold, which pushes the cope 1 and the drag 2, an impact that is applied to the plate 210 for receiving the mold, a difference in levels of the plate 210 for receiving the mold and the means 300 for transporting the cope and the drag, a time that has elapsed from a finishing of pouring to a shake-out, and an acceleration of the cylinder 120 for pushing out the mold in a direction to push out the cope and the drag. By this configuration, determining a cause of a mold shift or taking an action to preliminarily prevent a mold shift can be effectively carried out.

The method of a tenth aspect of the present invention, for example, as in FIGS. 1-8, comprises a step of pushing out the cope 1 and the drag 2 on the plate 210 for receiving the mold to the plate 110 for passing the mold by the cylinder 120 for pushing out the mold and further to the means 300 for transporting the cope 1 and the drag 2, instead of the step of pushing out the cope 1 and the drag 2 on the plate 210 for receiving the mold to a means 300 for transporting the cope 1 and the drag 2 by means of a cylinder 120 for pushing out a mold. The specific data are at least one kind of data on a size of fouling on the lower squeezing board 220, a difference between the temperature of the molding sand 290 to be filled and the temperature of the lower squeezing board 220, a size of fouling on the plate 210 for receiving the mold, a size of fouling on the plate 110 for passing the mold, an existence of fouling on the means 300 for transporting the cope and the drag, a waveform of a pressure or an electric current to drive the cylinder 120 for pushing out the mold, an impact that is applied to a pushing plate 122 by the cylinder 120 for pushing out the mold, which pushes the cope 1 and the drag 2, an impact that is applied to the plate 210 for receiving the mold, a difference between the level of the plate 210 for receiving the mold and the level of the plate 110 for passing the mold, a difference between the level of the plate 110 for passing the mold and the level of the means 300 for transporting the cope and the drag, a time that elapses from a finishing of pouring to a shake-out, and an acceleration of the cylinder 120 for pushing out the mold in a direction to push out the cope and the drag. By this configuration, determining a cause of a mold shift or taking an action to preliminarily prevent a mold shift can be effectively carried out.

A flaskless molding line of an eleventh aspect of the present invention comprises, for example, as in FIGS. 1-7, a flaskless molding machine 200 that molds a cope 1 and a drag 2 by filling molding sand 290 in an upper flask 250 and a lower flask 240 and squeezing it by means of an upper squeezing board and a lower squeezing board and that pushes out the cope 1 and the drag 2 that have been assembled from an upper flask 250 and a lower flask 240 onto the plate 210 for receiving the mold. It also comprises a means 300 for transporting the cope 1 and the drag 2 to a shake-out machine 500 via a position where molten metal is poured into the cope 1 and the drag 2 from a pouring machine 800. It also comprises a cylinder 120 for pushing out the mold that pushes out the cope 1 and the drag 2 on the plate 210 for receiving the mold to the means 300 for transporting the cope and the drag. It also comprises a measuring means 124, 126, 128, 140, 212, 224, 226, 270, 338 that measures specific data at positions where a mold shift may occur during a process for manufacturing or taking out the cope 1 and the drag 2. It also comprises a controller 700 that stores data on an allowable range for the specific data that are obtained and that determines if the obtained specific data are within the allowable range.

By this configuration, during the process for manufacturing or taking out the cope and the drag that have been manufactured by a flaskless molding machine and assembled, it can be determined in real time if a mold shift has occurred in the current cycle based on whether the specific data that are obtained at positions where a mold shift may occur are within the allowable range. Thus, in the flaskless molding line an action can be quickly taken based on the determination and a mold shift can be prevented in the middle of a cycle.

The flaskless molding line of a twelfth aspect of the present invention, for example, as in FIGS. 2 and 13, further comprises a device 3 for detecting a mold shift that detects a mold shift of the cope 1 and the drag 2. The controller 700 determines if a mold shift has occurred. By this configuration, a relationship between a comparison of the obtained specific data with the allowable range and the determination on the occurrence of a mold shift can be found.

By the flaskless molding line of a thirteenth aspect of the present invention, for example, as in FIGS. 2 and 14, the controller 700 modifies the allowable range for the specific data based on the determination on an occurrence of a mold shift. By this configuration, since the allowable range for the specific data is modified based on the determination on an occurrence of a mold shift, the allowable range can be optimized.

By the flaskless molding line of a fourteenth aspect of the present invention, for example, as in FIGS. 2 and 15, the controller 700 causes the step of preventing a mold shift to be implemented by using the obtained specific data and the allowable range that has been modified. By this configuration, since an action for preventing a mold shift is implemented by using the optimized allowable range, a mold shift can be prevented from occurring.

By the flaskless molding line of a fifteenth aspect of the present invention, for example, as in FIGS. 1-7 and 10, the measuring means is at least one of a means 226 for measuring fouling on the lower squeeze board that measures a size of fouling on the lower squeezing board 220; a means 270 for measuring the temperature of the molding sand that measures the temperature of the molding sand 290 to be filled and a means 224 for measuring the temperature of the lower squeeze board that measures the temperature of the lower squeezing board 220; a means 124 for measuring fouling on the plate for receiving the mold that measures a size of fouling on the plate 210 for receiving the mold; a means 338 for measuring fouling on the means for transporting the cope and the drag that measures an existence of fouling on the means 300 for transporting the cope and the drag; a means 126 for measuring a waveform of the cylinder for pushing out a mold that measures the waveform of the pressure or the electric current that drives the cylinder 120 for pushing out the mold; a means 128 for measuring an impact on the pushing plate that measures an impact applied to the pushing plate 122 of the cylinder 120 for pushing out the mold that pushes the cope 1 and the drag 2; and a means 212 for measuring an impact on the plate for receiving a mold that measures an impact applied to the plate 210 for receiving the mold. By this configuration, determining the cause of a mold shift and preventing a mold shift can be effectively carried out.

The flaskless molding line of a sixteenth aspect of the present invention further comprises, for example, as in FIGS. 1 and 2, a plate 110 for passing the mold that is a path for transporting the cope 1 and the drag 2 between the plate 210 for receiving the mold and the means 300 for transporting the cope 1 and the drag 2. It further comprises as the measuring means a means 124 for measuring fouling on the plate for passing the mold that measures a size of fouling on the plate 110 for passing the mold, or a means 124 for measuring a difference between the level of the plate for receiving the mold and the level of the plate for passing the mold that measures a difference between the level of the plate 210 for receiving the mold and the level of the plate 110 for passing the mold, or a means 140 for measuring a difference between the level of the plate for passing the mold and the level of the means for transporting the cope and the drag that measures a difference between the level of the plate 110 for passing the mold and the level of the means 300 for transporting the cope and the drag. By this configuration, a cope and a drag can be smoothly transported from the flaskless molding machine to the means for transporting the cope and the drag. Further, determining the cause of a mold shift and preventing a mold shift can be effectively carried out.

By the method of the present invention for reducing occurrences of a mold shift of a cope and a drag that have been molded by a flaskless molding machine and have been assembled or by the flaskless molding line of the present invention, the cause of the mold shift is quantitatively estimated based on the specific data obtained at positions where a mold shift may occur. The specific data are determined to see if they are within an allowable range. Thus, a proper action can be taken to reduce the occurrences of a mold shift of a cope and a drag.

The basic Japanese patent application, No. 2017-202337, filed Oct. 19, 2017, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

DESCRIPTION OF EMBODIMENTS

Figure 1:
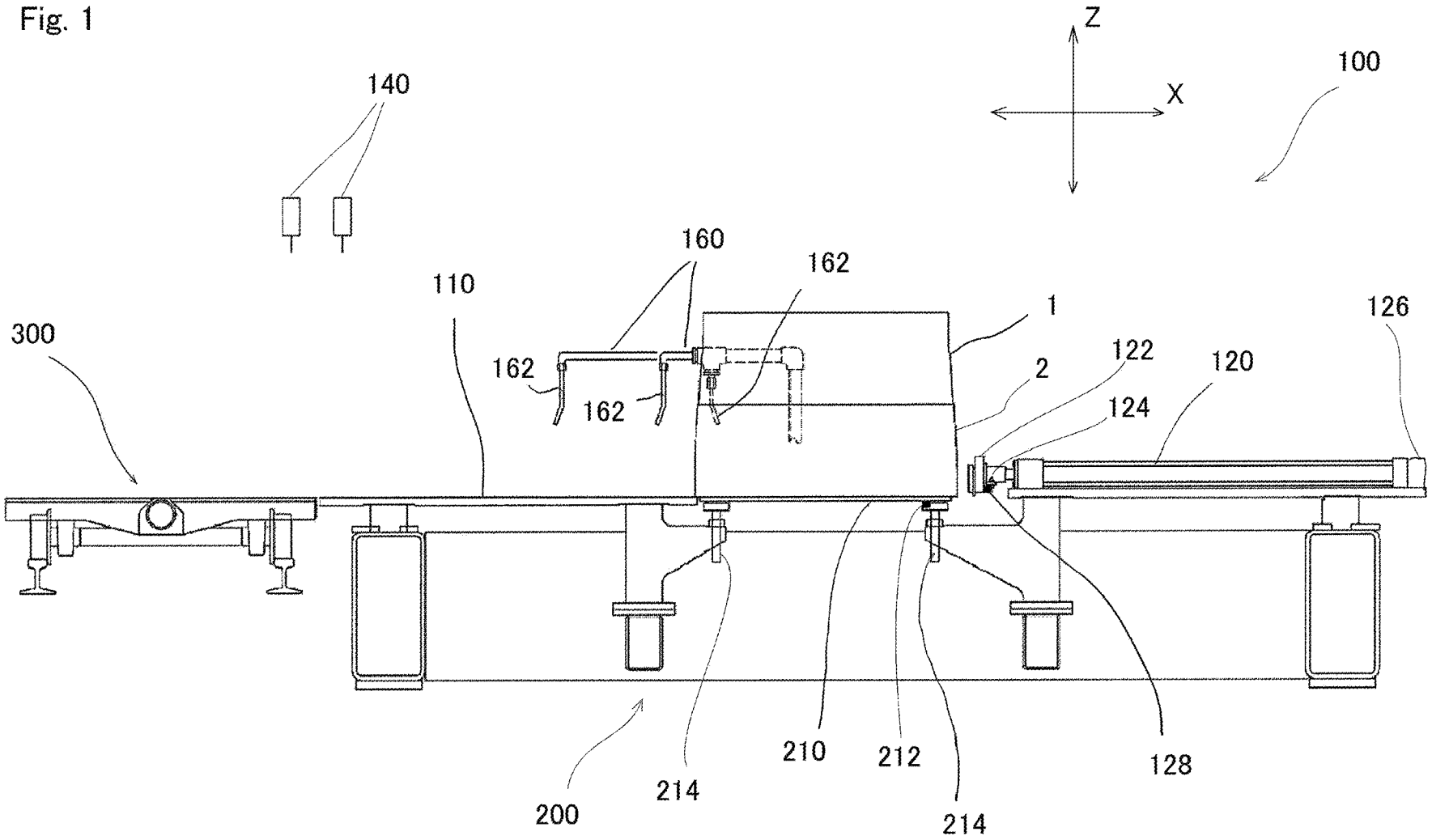
FIG. 1 is a partial front view of the flaskless molding line of an embodiment of the present invention.

Below the embodiments of the present invention are discussed with reference to the drawings. In the drawings, the same or corresponding members are denoted by the same reference numbers. Thus, duplicate descriptions are omitted. First, with reference to FIGS. 1, 2, and 3, a flaskless molding line 100 is discussed.

Figure 2:
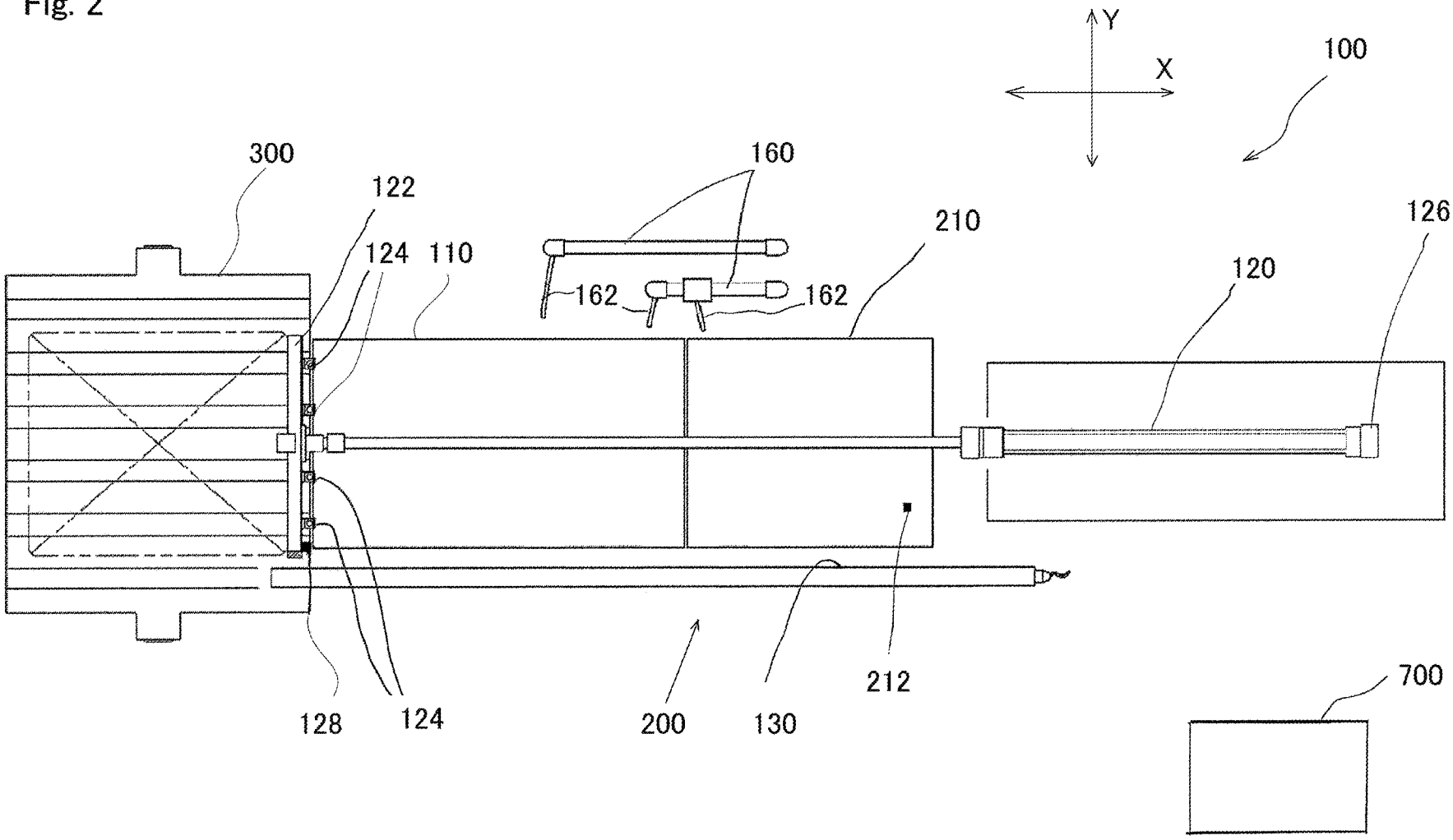
FIG. 2 is a partial plan view of the flaskless molding line as in FIG. 1.
Figure 3:
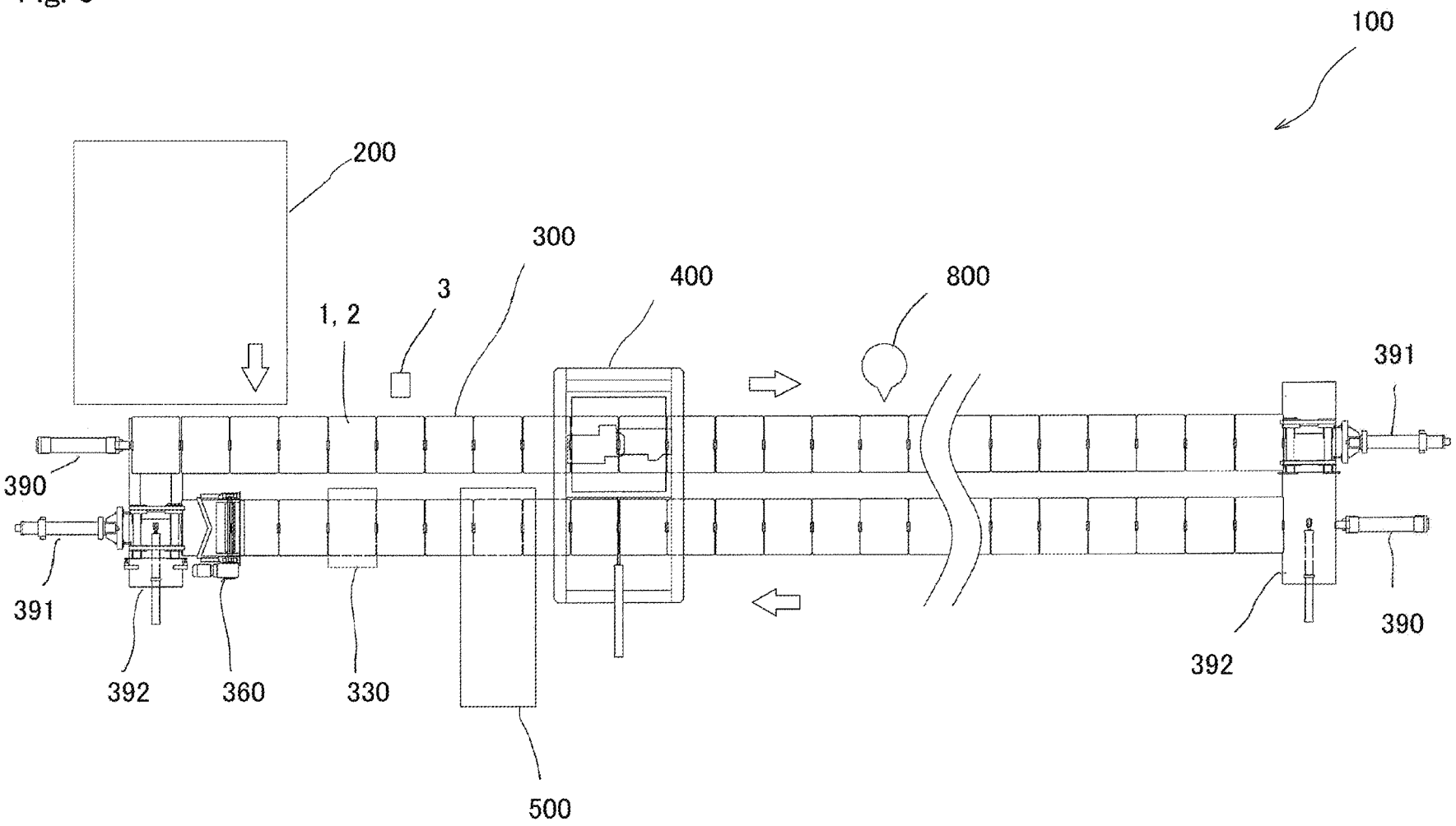
FIG. 3 is a plan view of the flaskless molding line.

FIGS. 1 and 2 are a partial front view and a partial plan view of the flaskless molding line 100, respectively. FIG. 3 is a plan view of the entire flaskless molding line 100, in which the arrows denote the directions that a cope 1 and a drag 2 are to move. The flaskless molding line 100 includes a flaskless molding machine 200 that assembles and sends the cope 1 and the drag 2 that have been molded by using molding sand 290. It also includes a means 300 for transporting the cope and the drag. It also includes a device 400 for transferring a jacket and a weight that places a jacket on the cope 1 and the drag 2 and a weight on them, to prevent a mold from shifting during transportation. It also includes a shake-out machine 500 that shakes out a casting that has been solidified by being cooled from the cope 1 and the drag 2.

The means 300 for transporting the cope and the drag places the cope 1 and the drag 2 that have been sent from the flaskless molding machine 200 onto a carriage 310 with a molding board (see FIGS. 9 and 10), transports them to a position where molten metal is poured by a pouring machine 800, and further to the shake-out machine 500 while cooling the cope 1 and the drag 2 into which the molten metal has been poured. It has a route to return the carriage 310 with the molding board to the flaskless molding machine 200 while a groove and an upper surface of the carriage 310 with the molding board are cleaned by means of a scraper 330 and a cleaning means 360. On the route, the straight parts of the route are arranged in parallel. In FIG. 3, the route is shown to have one round. However, it may have two or more rounds. On the straight route, the carriage 310 with the molding board is intermittently transported by a pitch (a length of a mold) by means of a pusher 390 and a cushion 391 that are provided at the ends of the route. At the end of the straight route, the carriage 310 with the molding board is transferred to the next straight route by means of a traverser 392.

As in FIGS. 1 and 2, the flaskless molding line 100 has a plate 110 for passing the mold that provides a route for transporting the cope 1 and drag 2 that have been molded and assembled by the flaskless molding machine 200 from a plate 210 for receiving the mold of the flaskless molding machine 200 to the means 300 for transporting the cope and the drag. It also has a cylinder 120 for pushing out the mold that pushes out the cope 1 and the drag 2 from the plate 210 for receiving the mold to the means 300 for transporting the cope and the drag via the plate 110 for passing the mold.

The plate 110 for passing the mold is a flat plate that is located between the plate 210 for receiving the mold and the means 300 for transporting the cope and the drag so that the upper surface of it is at almost the same height as that of the plate 210 and that of the means 300 (in this embodiment, the upper surface of the carriage 310 with the molding board {see FIGS. 9 and 10}, as described below). The upper surface is smooth so that the cope 1 and the drag 2 can be easily pushed out. Incidentally, the flaskless molding line 100 may be configured to have no plate 110 for passing the mold so that the cope 1 and the drag 2 are directly pushed out from the plate 210 for receiving the mold to the carriage 310 with the molding board. Below, the flaskless molding line 100 is discussed as having the plate 110 for passing the mold. Thus, if it has no plate 110 for passing the mold, the description on the relationships between the plate 210 for receiving the mold and the plate 110 for passing the mold and between the plate 110 for passing the mold and the carriage 310 with the molding board should be read as specifying the relationship between the plate 210 for receiving the mold and the carriage 310 with the molding board, when appropriate.

The cylinder 120 for pushing out the mold is shown as being contracted in FIG. 1 and as being elongated in FIG. 2. It may be contracted and elongated by a fluid pressure (air or liquid), a mechanical force, or an electrical force. In this embodiment a fluid pressure (an oil pressure) is used. In the cylinder 120 for pushing out the mold the means 126 for measuring a waveform of the cylinder for pushing out a mold is provided to measure a waveform of the fluid pressure to activate the cylinder. The means 126 for measuring a waveform of the cylinder for pushing out a mold may be a publicly-known pressure gage. If an electrical force is used for the cylinder 120 for pushing out the mold, the means 126 for measuring a waveform of the cylinder for pushing out a mold is an ammeter to measure a waveform of an electric current. Near the cylinder 120 for pushing out the mold an encoder 130 is provided to measure a length of elongation of the cylinder 120. By means of the encoder 130 how far the cope 1 and the drag 2 are pushed by the cylinder 120 for pushing out the mold, that is, the position of the cope 1 and the drag 2, can be calculated.

At the tip of the cylinder 120 for pushing out the mold the pushing plate 122 is attached to push the cope 1 and the drag 2. The pushing plate 122 has almost the same width (the Y-direction in FIG. 2) as that of the cope 1 and the drag 2, so as not to apply a local force to the cope 1 and the drag 2 by the cylinder 120 for pushing out the mold and so as to improve the contact. Multiple two-dimensional laser-type displacement sensors 124 are provided to the pushing plate 122 in the direction of its width. Four two-dimensional laser-type displacement sensors 124 are shown in FIG. 2, but the number of sensors is not limited to four. They are provided to measure the entire width of the plate 210 for receiving the mold and the plate 110 for passing the mold. The two-dimensional laser-type displacement sensor 124 measures the size (an area and a height) of the fouling on the plate 210 for receiving the mold and the plate 110 for passing the mold and measures the difference between the level of the plate 210 for receiving the mold and that of the plate 110 for passing the mold. The size of the fouling on the plate 210 for receiving the mold and the plate 110 for passing the mold is preferably measured twice, i.e., when the cylinder 120 for pushing out the mold is caused to elongate to push out the cope 1 and the drag 2 onto the carriage 310 with the molding board, and when it is caused to contract after pushing them out on the carriage 310 with the molding board. That is, the two-dimensional laser-type displacement sensors 124 function as the means for measuring fouling on the plate for receiving the mold, the means for measuring fouling on the plate for passing the mold, and the means for measuring a difference between the level of the plate for receiving the mold and the level of the plate for passing the mold. Incidentally, the means for measuring fouling on the plate for receiving the mold, the means for measuring fouling on the plate for passing the mold, and the means for measuring a difference between the level of the plate for receiving the mold and the level of the plate for passing the mold may be separate sensors, such as laser-type displacement sensors. For the two-dimensional laser-type displacement sensor 124, for example, LJ-V7300, which is supplied by Keyence Corporation (Japan), is preferably used. A three-dimensional acceleration sensor 128 is provided on the reverse surface (a surface that is reverse to the surface for pushing the cope 1 and the drag 2) or the area adjacent to the pushing plate 122. The pushing plate 122 inextricably contacts the cope 1 and the drag 2. For example, if fouling exists on the plate 210 for receiving the mold or the plate 110 for passing the mold, the cope 1 and drag 2 that slide on that fouling by being pushed are subject to an impact. Since that impact is transmitted to the pushing plate 122, it can be measured by the three-dimensional acceleration sensor 128. That is, the three-dimensional acceleration sensor 128 functions as the means for measuring an impact on the pushing plate. Here, measuring an impact denotes measuring accelerations in the directions of the impact, i.e., to measure accelerations in the transporting direction (the X-direction) and the vertical direction (the Z-direction). An acceleration in the lateral direction (the Y-direction) may be measured. The word "impact" in this invention includes the meaning of acceleration. A vibration can be measured by measuring an acceleration.

A laser-type displacement 140 is provided above the plate 110 for passing the mold and the means 300 for transporting the cope and the drag to measure a step between them. In FIG. 1 two laser-type displacement sensors 140 are provided to measure the level of the upper surface of the plate 110 for passing the mold and the level of the upper surface of the means 300 for transporting the cope and the drag, so that the difference in their levels is calculated by using the measured levels. However, just one laser-type displacement sensor 140 may measure that difference.

A device 160 for blowing air is provided along the plate 210 for receiving the mold and the plate 110 for passing the mold. The device 160 for blowing air has multiple air nozzles 162 to remove fouling that is attached to the upper surface of the plate 210 for receiving the mold and the plate 110 for passing the mold by blowing air. In FIGS. 1 and 2 three air nozzles 162 are shown. Multiple air nozzles 162 are provided to remove fouling by blowing air on the entire upper surface of the plate 210 for receiving the mold and the plate 110 for passing the mold. The device 160 for blowing air has a source of compressed air (not shown), such as a compressor for supplying compressed air. However, since it can be a known device, the explanation is omitted. Incidentally, the device 160 for blowing air may have just one air nozzle 162.

Figure 4:
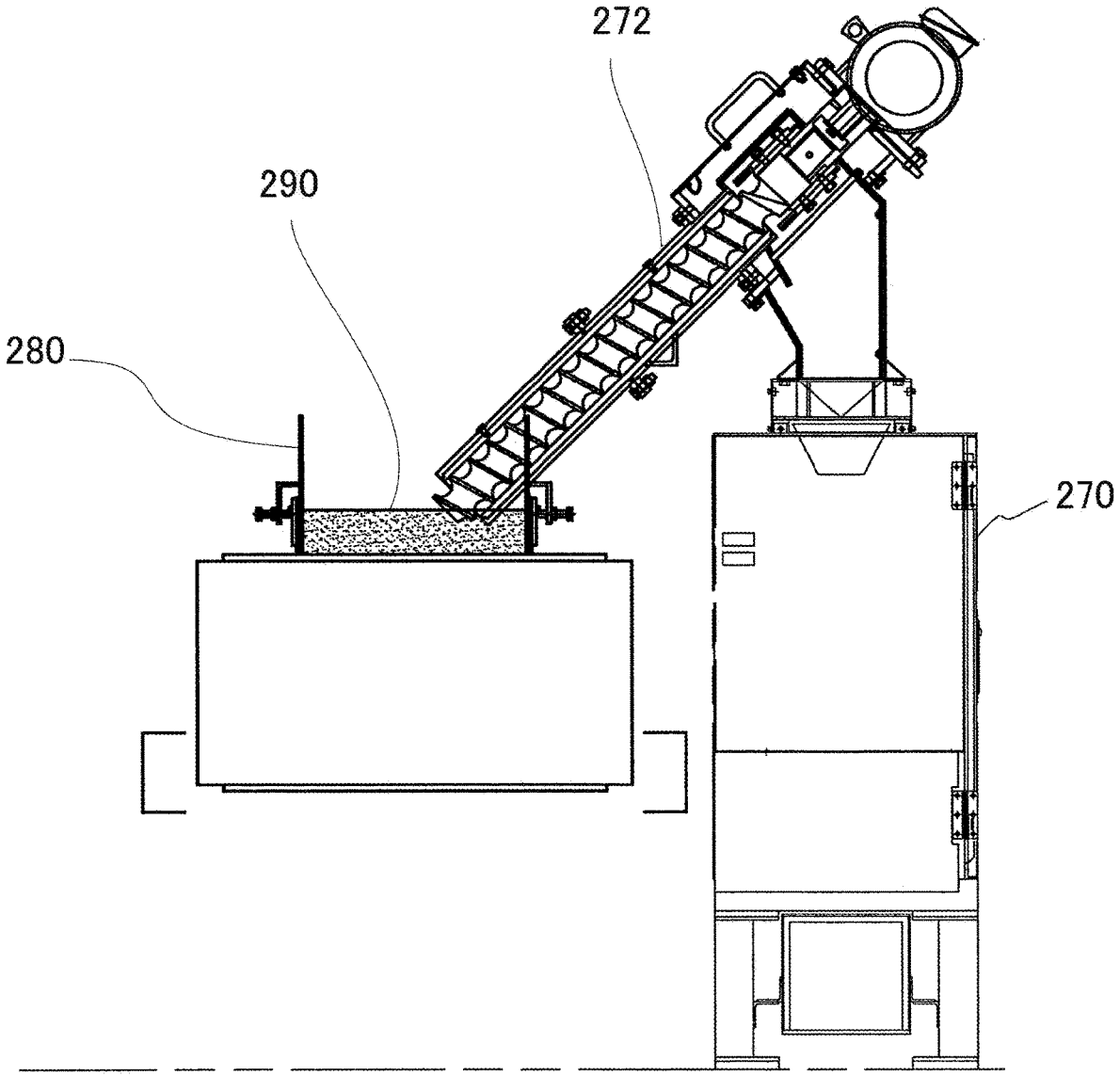
FIG. 4 is a side view that illustrates the configuration of the device for measuring the temperature, etc., of the molding sand to be supplied to the flaskless molding machine.

With reference to FIG. 4, measuring the temperature of the molding sand (also called "sand for molding") 290 to be supplied to the flaskless molding machine 200 is now discussed. The molding sand 290 is conveyed by a conveyor 280 from a device for storing molding sand (not shown) to the flaskless molding machine 200. A part of the molding sand 290 that is conveyed by the conveyor 280 is taken out by a device 272 for taking out the molding sand. The device 272 for taking out the molding sand has a screw within a cylinder to pick the molding sand 290 on the conveyor by means of the rotating screw to supply it to a device 270 for automatically measuring the properties of the molding sand. The device 270 for automatically measuring the properties of the molding sand measures the temperature, etc., of the molding sand 290 that is supplied. Incidentally, the temperature of the molding sand 290 may be measured by directly using, for example, the molding sand 290 in the flaskless molding machine 200, or by another method.

The flaskless molding machine 200 introduces the molding sand 290 into a space for a cope and a drag that are surrounded by the upper flask 250 (see FIG. 8), a matchplate (not shown) and an upper squeezing board (not shown), and the lower flask 240 (see FIG. 8), a matchplate (not shown), and the lower squeezing board 220 (see FIGS. 5 and 6), to mold the cope 1 and the drag 2, by squeezing by means of the upper squeezing board.

Figure 5:
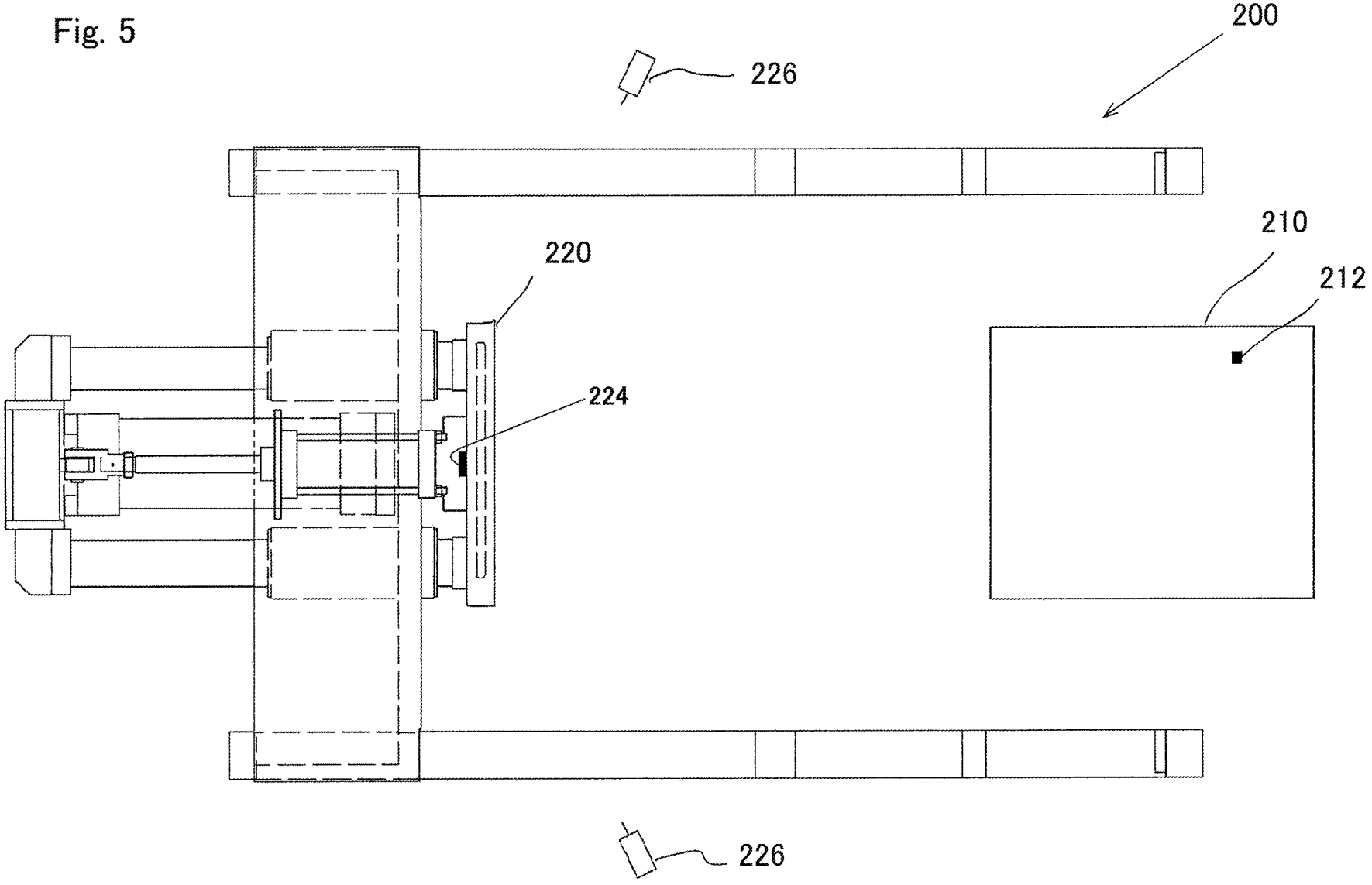
FIG. 5 is a partial plan view that illustrates the lower squeeze board and its surrounding area of the flaskless molding machine.
Figure 6:
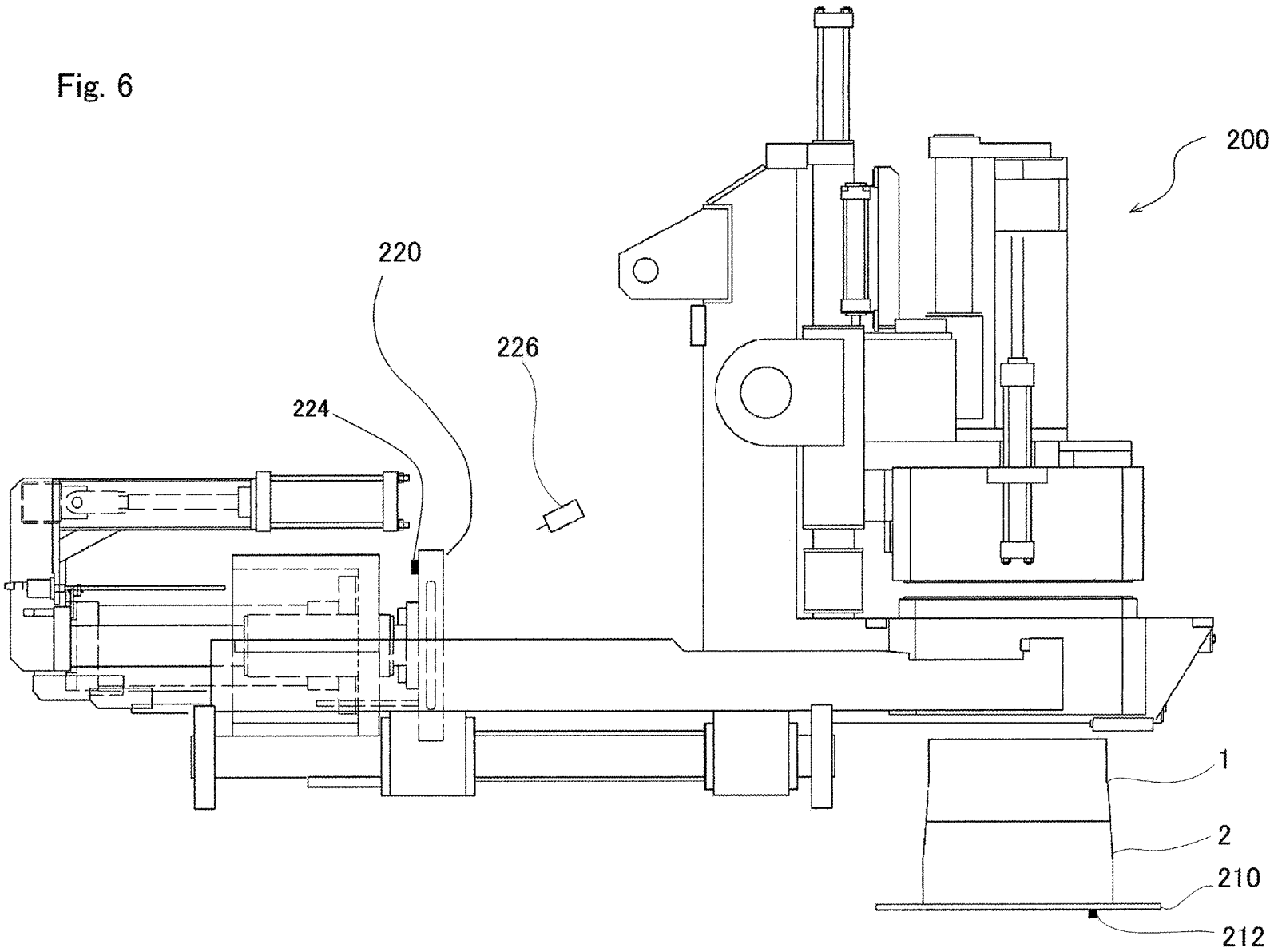
FIG. 6 is a partial side view that illustrates the lower squeeze board and its surrounding area of the flaskless molding machine.
Figure 7:
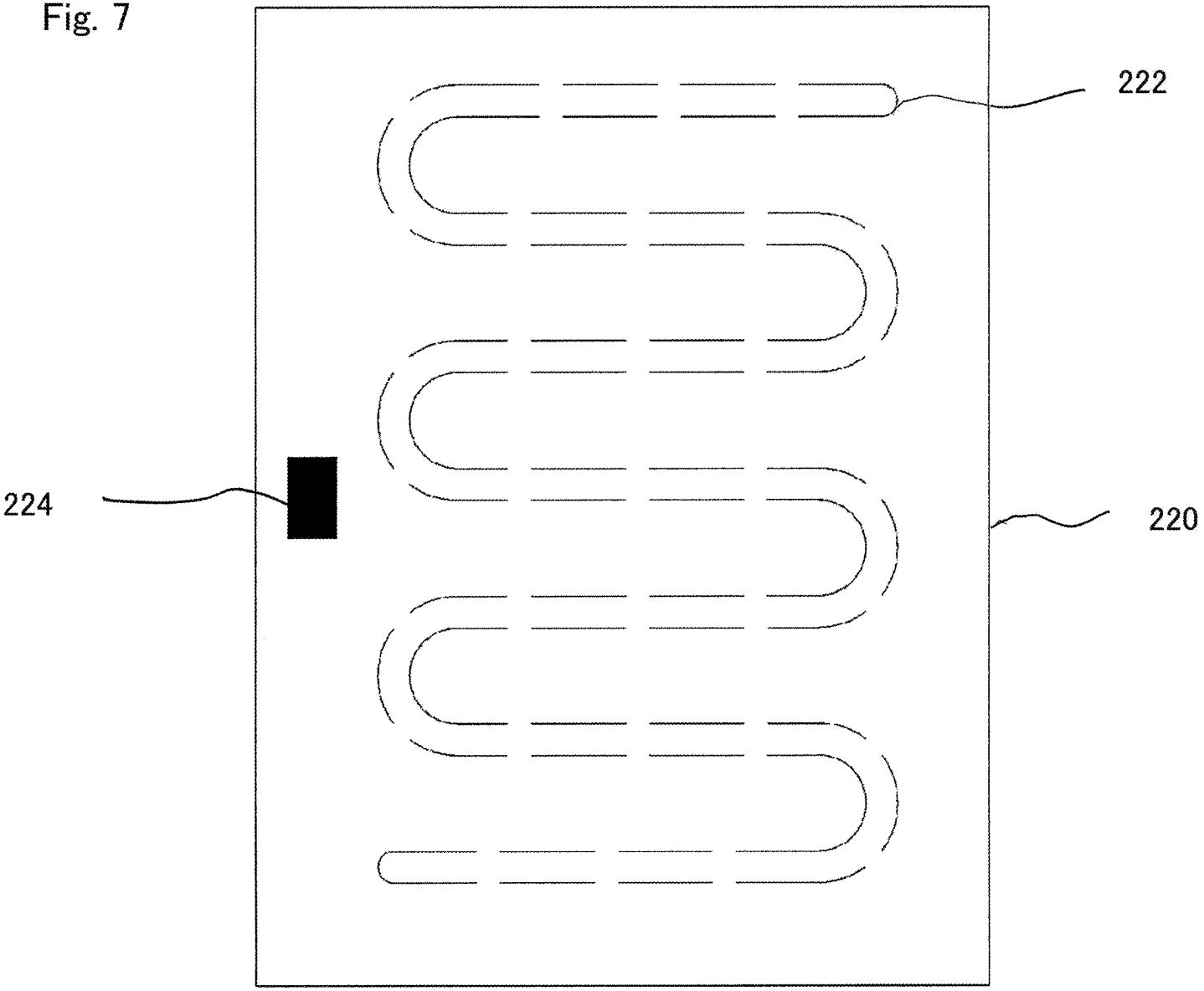
FIG. 7 is a front view that illustrates the heater and the thermometer of the lower squeeze board.

As in FIGS. 5 and 6, the flaskless molding machine 200 has a two-dimensional laser-type displacement sensor 226 (for example, LJ-V7300, supplied by Keyence Corporation), which is the means for measuring fouling on the lower squeeze board, to measure fouling on the surface of the lower squeezing board 220. The two-dimensional laser-type displacement sensor 226 may be located at a device other than the flaskless molding machine 200, such as a rack that is provided near the flaskless molding machine 200. Incidentally, the means for measuring fouling on the lower squeeze board may be a device for recognizing an image. As shown in FIG. 7 for details, a heater 222 is provided at the reverse surface of, or within, the lower squeezing board 220, to heat the lower squeezing board 220. The heater 222 is preferably provided in a zigzag pattern to heat the entire lower squeezing board 220. A thermometer 224, which is the means for measuring the temperature of the lower squeeze board 220, is also provided. The thermometer 224 may be embedded in the lower squeezing board 220.

Figure 8:
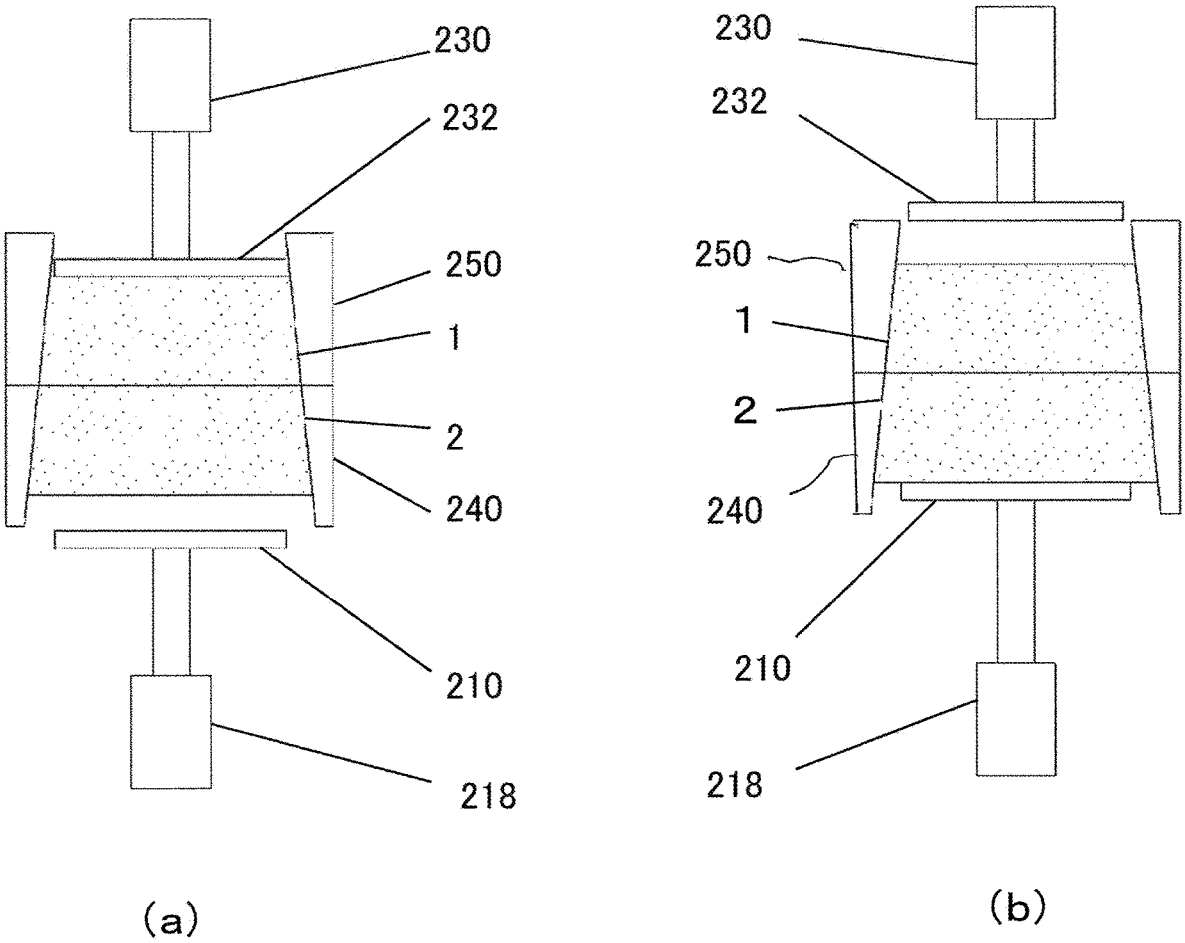
FIG. 8 illustrates the operation for stripping the cope and the drag from the flasks. (a) shows that the cylinder for stripping the mold pushes out the cope and the drag before the plate for receiving the mold contacts the cope and the drag. (b) shows that the cylinder for stripping the mold pushes out the cope and the drag after the plate for receiving the mold contacts the cope and the drag.

As in FIG. 8, the cope 1 and the drag 2 that have been molded are assembled after removing the matchplates. Then they are downwardly pushed out by the cylinder 230 for stripping the mold through a plate 232 for pushing the mold. Thus, they are stripped from the upper flask 250 and the lower flask 240. In one type of the flaskless molding machine 200 the cylinder for stripping the mold may double as the plate 232 for pushing the mold.

The cope 1 and the drag 2 that have been stripped from the upper flask 250 and the lower flask 240 are received by the plate 210 for receiving the mold. The plate 210 for receiving the mold can be vertically moved by means of a cylinder 218 for the plate for receiving the mold. As in FIG. 8(*a*), if the plate 210 for receiving the mold were to strip the cope 1 and the drag 2 by the cylinder 230 for stripping the mold through the plate 232 for pushing the mold before the plate 210 for receiving the mold contacts the cope 1 and the drag 2, then the cope 1 and the drag 2 would drop on the plate 210 for receiving the mold to apply an impact to the cope 1 and the drag 2. Thus, a mold shift may readily occur. So, as in FIG. 8(*b*), the plate 232 for pushing the mold preferably contacts and pushes out the cope 1 and the drag 2 after the plate 210 for receiving the mold contacts the cope 1 and the drag 2. As in FIGS. 1 and 2, a three-dimensional acceleration sensor 212 is provided to the plate 210 for receiving the mold to measure an impact that applies to the plate 210 for receiving the mold, such as an impact caused by the dropping of the cope 1 and the drag 2, as the means for measuring an impact on the plate for receiving a mold. The three-dimensional acceleration sensor 212 may be a known acceleration sensor. The level to lower the plate 210 for receiving the mold, i.e., the level to push out the cope 1 and the drag 2, may be adjustable by means of a stopper bolt 214 (see FIG. 1).

Figure 9:
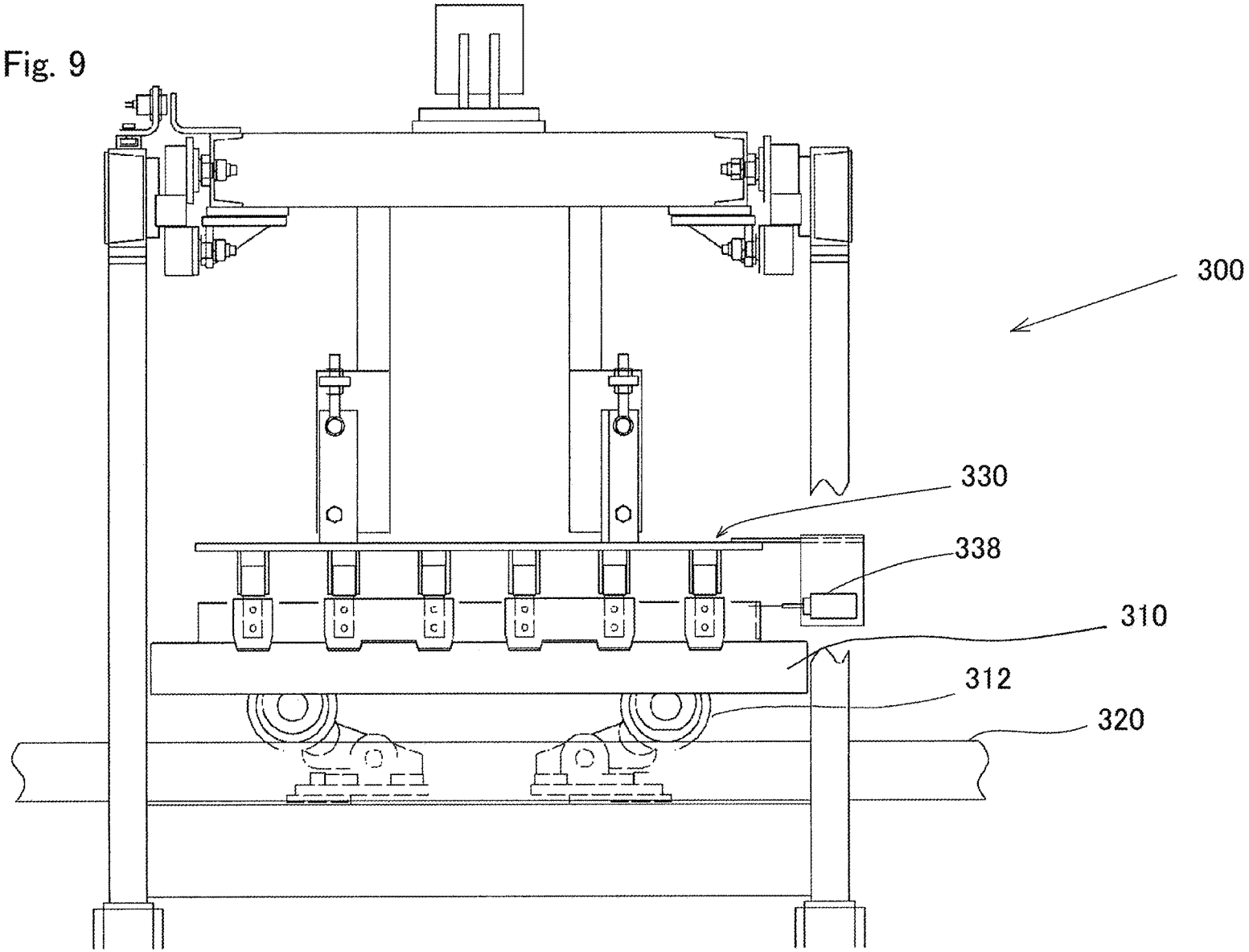
FIG. 9 is a side view that illustrates the scraper that is seen from the direction that is perpendicular to the direction for transporting the cope and the drag by the means for transporting the cope and the drag.
Figure 10:
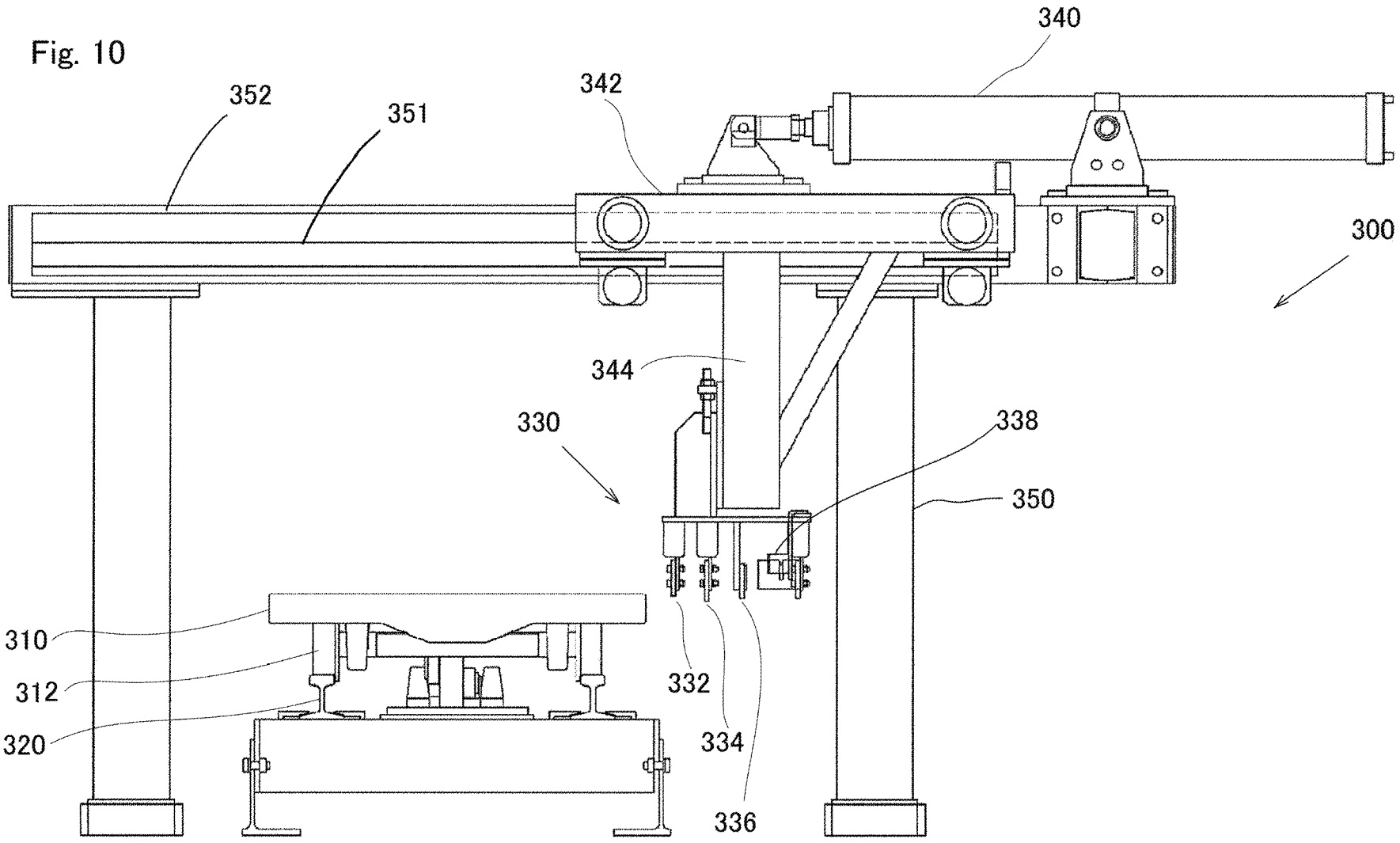
FIG. 10 is a front view that illustrates the scraper that is seen from the direction that is perpendicular to the direction of FIG. 9.

With reference to FIGS. 9 and 10, the means 300 for transporting the cope and the drag is now discussed. The means 300 for transporting the cope and the drag transports the cope 1 and the drag 2 from the flaskless molding machine 200 to the pouring machine 800 wherein molten metal is poured into the cope 1 and the drag 2. It further transports them to the shake-out machine 500 wherein the mold is broken after the molten metal has been cooled and solidified to be a casting and wherein the casting is separated from the molding sand. Alternatively, it transports the cope 1 and the drag 2 to an area (not shown) for temporarily storing them. In this embodiment, it is the carriage 310 with the molding board that travels on a rail 320 by means of rollers 312. Since the carriage 310 with the molding board caused the cope 1 and the drag 2 to be placed thereon and travels on the rail 320, it transports the cope 1 and the drag 2.

The means 300 for transporting the cope and the drag has a scraper 330 to clean the groove and the upper surface of the carriage 310 with the molding board. The scraper 330 has a scraper 332 for the groove that has a steel plate to remove sand, etc., that adheres to the groove on the upper surface of the carriage 310 with the molding board. The steel plate is held by rubber. It also has a scraper 334 for the upper surface that has a steel plate to remove sand, etc., that adheres to the upper surface of the carriage 310 with the molding board. The steel plate is held by rubber. It also has a scraper 336 for finishing that contacts the groove and the upper surface of the carriage 310 with the molding board to carry out the finishing of the cleaning. It also has a touch-activated switch 338, which is the means for measuring fouling on the means for transporting the cope and the drag, to detect fouling on the groove and the upper surface of the carriage 310 with the molding board. The touch-activated switch 338 is a switch wherein, when a protruding object (fouling) adheres to the groove or the upper surface of the carriage 310 with the molding board, a plate inclines by touching the protruding object to contact a needle contact, to detect the fouling. The means for measuring fouling on the means for transporting the cope and the drag may be another known means that can measure a protruding object that adheres to the groove and the upper surface of the carriage 310 with the molding board. It may have a laser-type displacement sensor to measure fouling on the groove and the upper surface of the carriage 310 with the molding board. The laser-type displacement sensor may be similar to the two-dimensional laser-type displacement sensor 124 of the means for measuring fouling on the plate for receiving the mold, the means for measuring fouling on the plate for passing the mold, the means for measuring a difference between the level of the plate for receiving the mold, and the level of the plate for passing the mold, etc.

The scraper 332 for the groove, the scraper 334 for the upper surface, the scraper 336 for finishing, and the touch-activated switch 338, are attached to a bar 344 for suspending the scrapers. The bar 344 for suspending the scrapers is hung from a carriage 342 that slides by means of a lateral cylinder 340 on a rail 351 that is attached to a beam 352 of a frame. The beam 352 of a frame spans a pair of columns 350 of a frame that are disposed at both ends of the beam 352. By contracting and elongating the lateral cylinder 340, the scraper 332 for the groove, the scraper 334 for the upper surface, the scraper 336 for finishing, and the touch-activated switch 338, reciprocate in the width-direction of the carriage 310 with the molding board.

Figure 11:
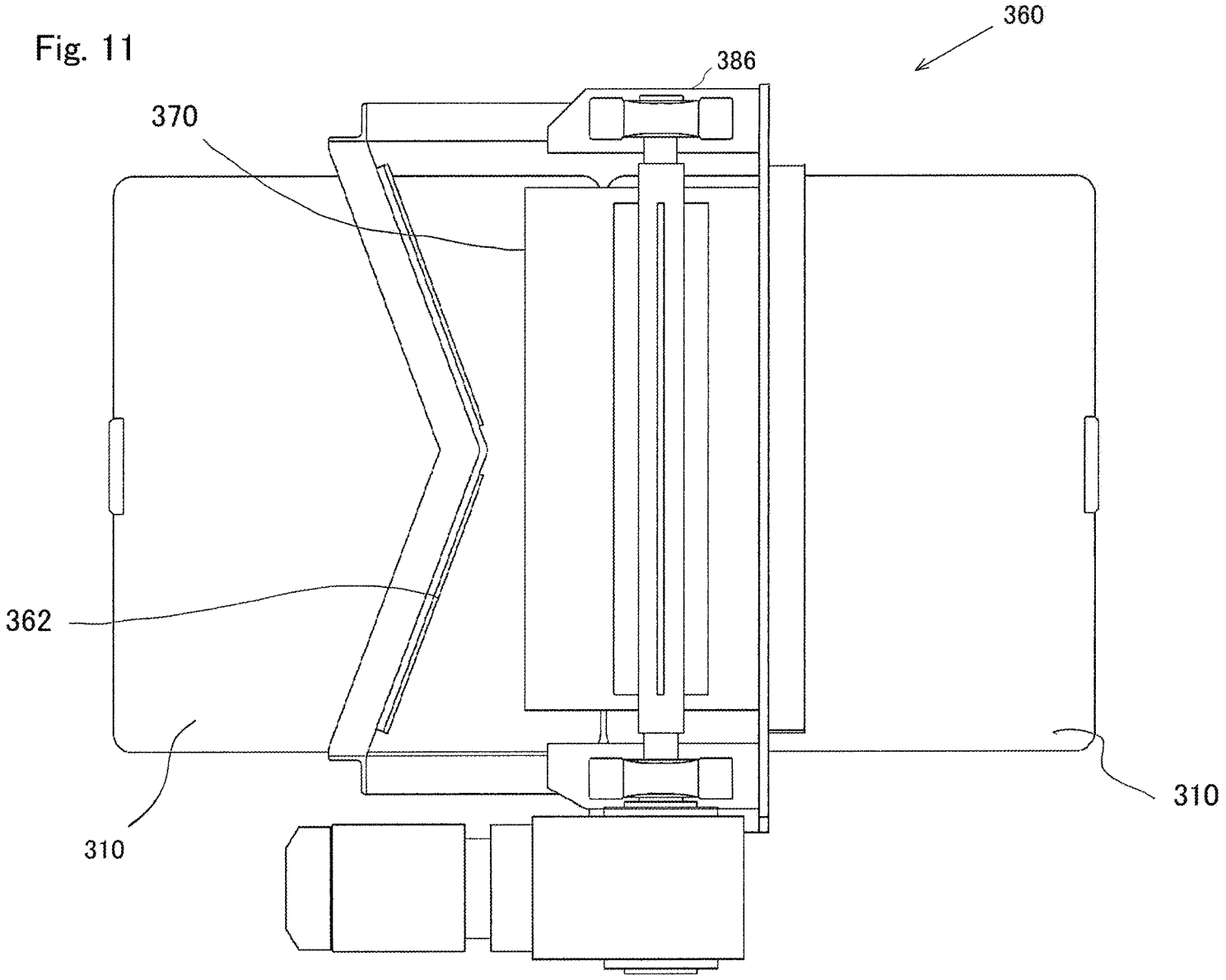
FIG. 11 is a plan view that illustrates a cleaning means other than the scraper of FIG. 9.
Figure 12:
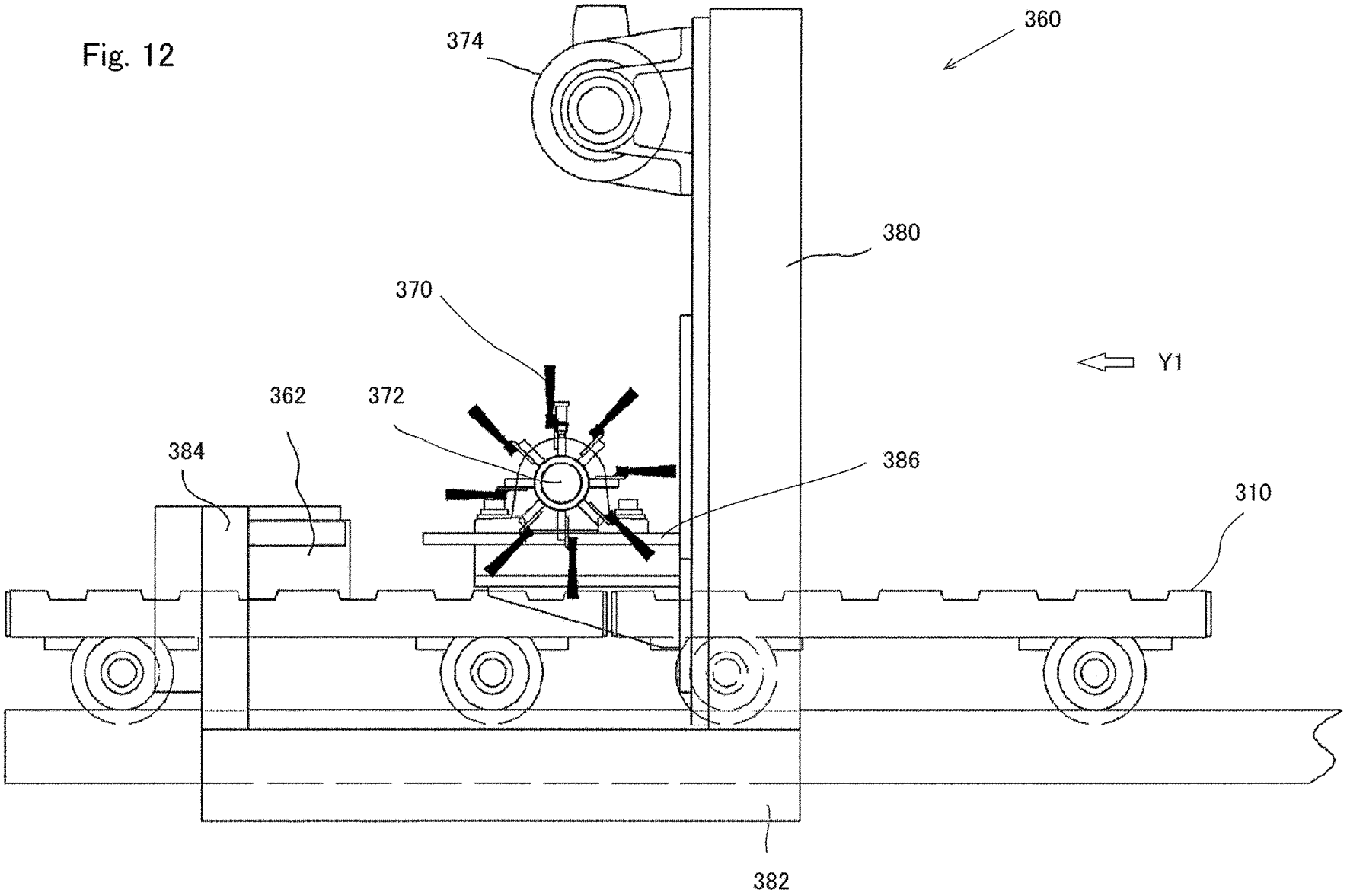
FIG. 12 is a side view of the cleaning means as in FIG. 11.

With reference to FIGS. 11 and 12, a cleaning means 360 that differs from the scraper 330 is now discussed. The cleaning means 360 has a rotating brush 370 that has multiple brushes. The rotating brush 370 rotates about a rotating shaft 372 to clean the groove and the upper surface of the carriage 310 with the molding board, by means of the brushes. It also has a scraper 362 made of rubber that scrapes by means of soft rubber the groove and the upper surface of the carriage 310 with the molding board to clean them. The rotating brush 370 is supported by a stand 386 that is fixed to a vertical frame 380. The rotating brush 370 is rotated by a motor 374 to act as a driver for rotating the rotating shaft 372. The motor 374 is supported by the vertical frame 380. A horizontal frame 382 that extends in the direction Y1 that the carriage 310 with the molding board travels is fixed to the lower end of the vertical frame 380. In the horizontal frame 382 a frame 384 for the scraper made of rubber is upwardly fixed to the downstream part of the vertical frame 380 in the traveling direction Y1 of the carriage 310 with the molding board. The scraper 362 made of rubber is fixed to the frame 384 for the scraper made of rubber. Both the rotating brush 370 and the scraper 362 made of rubber are long enough to clean almost the entire width of the carriage 310 with the molding board. A means for measuring fouling on the means for transporting the cope and the drag (not shown) that detects fouling on the groove and the upper surface of the carriage 310 with the molding board may be provided downstream of the scraper 362 made of rubber of the frame 384 for the scraper made of rubber in the direction Y1 that the carriage 310 with the molding board travels. The means for measuring fouling on the means for transporting the cope and the drag has a similar configuration as that of the touch-activated switch 338.

It is preferable that both the scraper 330 and the cleaning means 360 are equipped with the means 300 for transporting the cope and the drag of the flaskless molding line 100. If both are so equipped, the scraper 330 or the cleaning means 360 that is located downstream has preferably the means for measuring fouling on the means for transporting the cope and the drag, but this is not essential. The means 300 for transporting the cope and the drag may have either the scraper 330 or the cleaning means 360. If either one is provided, the scraper 330 or the cleaning means 360 has the means for measuring fouling on the means for transporting the cope and the drag. As in FIG. 3 in the flaskless molding line 100, the cleaning means 360 is located downstream and the scraper 330 is located upstream. The scraper 330 has the means for measuring fouling on the means for transporting the cope and the drag, i.e., the touch-activated switch 338.

Figure 13:
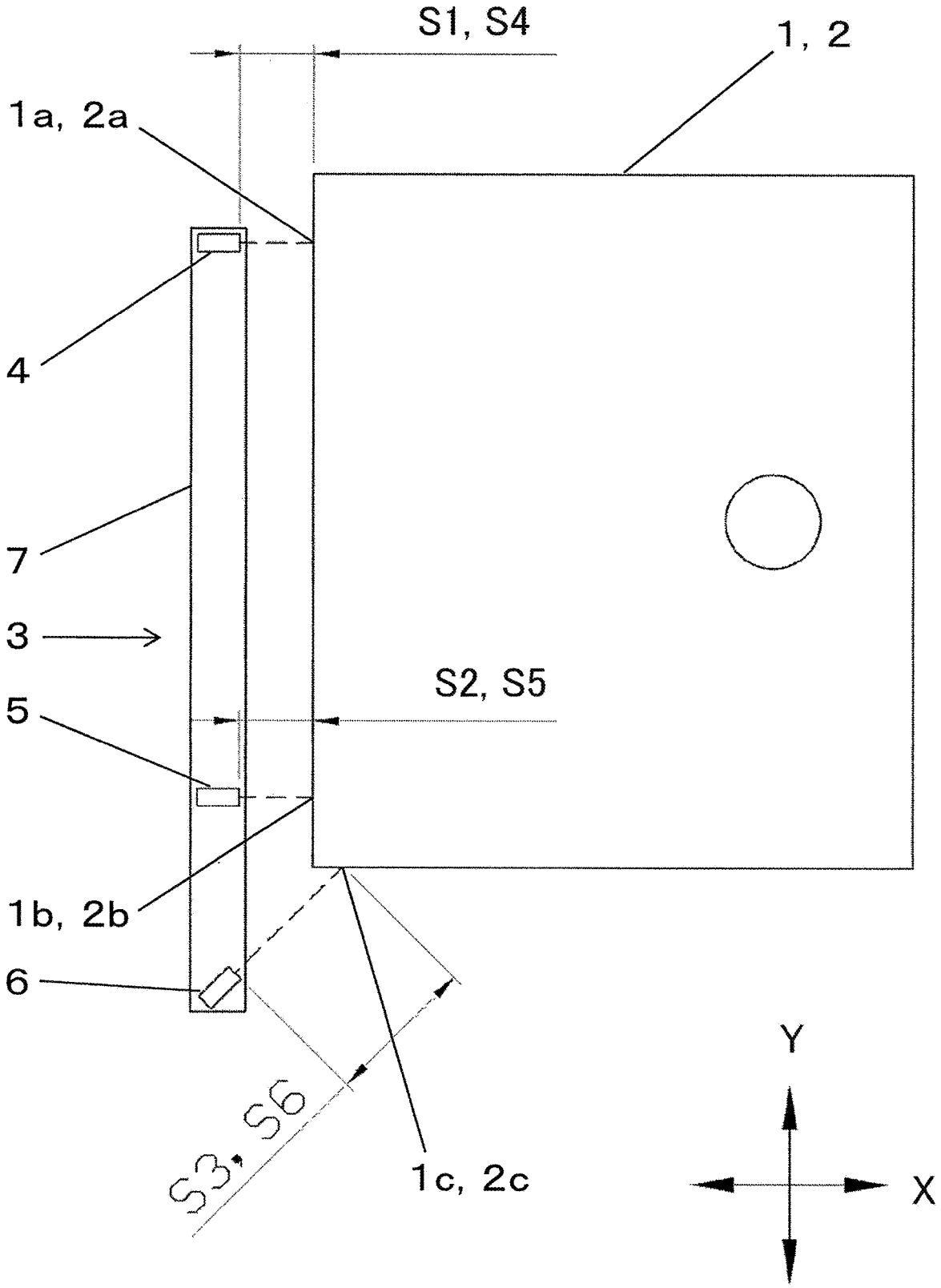
FIG. 13 is a side view that illustrates the device for detecting a mold shift.

The device 3 for detecting a mold shift as in FIG. 13 is provided at a fixed position of the flaskless molding line 100. The device 3 for detecting a mold shift is generally positioned along the means 300 for transporting the cope and the drag. The device 3 for detecting a mold shift has three means 4, 5, 6 for measuring distances to the cope and the drag on the frame 7 for moving up and down that extends in the direction to transport the cope 1 and the drag 2 (the Y-direction in FIG. 13). The means 4, 5, 6 for measuring distances to the cope and the drag may be known displacement sensors, such as laser displacement sensors, ultrasonic displacement sensors, contact-type displacement sensors, etc. The frame 7 for moving up and down vertically moves the three displacement sensors 4, 5, 6 so that they measure the distances to the cope 1 and the distances to the drag 2. Thus, by the three displacement sensors 4, 5, 6, the distances S1, S2, S3 to three points 1*a*, 1*b*, 1*c* of the cope 1 and the distances S4, S5, S6 to three points 2*a*, 2*b*, 2*c* of the drag 2 can be measured. Since the coordinates of the three displacement sensors 4, 5, 6 are known, the coordinates of the three points of the cope 1 and those of the three points of the drag 2 are obtained. Since the shapes of the cope 1 and the drag 2 are known, the positions of the centers and the angles of horizontal rotations of them are calculated from the coordinates of the three points of them. A mold shift of the cope 1 and the drag 2 can be determined based on possible misalignments between the calculated positions of the centers and angles of horizontal rotations or possible misalignments between the coordinates of the four corners of the cope 1 and the drag 2 that are calculated from the positions of the centers and angles of horizontal rotations. The device 3 for detecting a mold shift may have both three displacement sensors for a cope and three displacement sensors for a drag, or an arbitrary number of displacement sensors, to determine if a mold shift of the cope 1 and the drag 2 has occurred. The configuration of the device 3 for detecting a mold shift is not limited to the one in the above discussion, and may be another type of configuration.

As in FIG. 2, the flaskless molding line 100 has the controller 700. The controller 700 controls the operation of the flaskless molding line 100. It may double as a controller that controls the operation of the flaskless molding machine 200 or the means 300 for transporting the cope and the drag. It may be a dedicated controller or a personal computer. The controller controls, through a wired or a wireless communication (not shown), the operations of the frame 7 for moving up and down, the cylinder 120 for pushing out the mold, the device 160 for blowing air, the flaskless molding machine 200 (including the upper squeezing board, the lower squeezing board 220, the heater 222, the device 270 for automatically measuring the properties of the molding sand, etc.), the means 300 for transporting the cope and the drag, the scraper 330, the cleaning means 360, etc. Further, it receives data that have been obtained by the means 4, 5, 6 for measuring distances to the cope and the drag, by a two-dimensional displacement sensor 124 (the means for measuring fouling on the plate for receiving the mold, by the means for measuring fouling on the plate for passing the mold, by the means for measuring a difference between the level of the plate for receiving the mold and the level of the plate for passing the mold), by the means 126 for measuring a waveform of the cylinder for pushing out a mold, by the means 128 for measuring an impact on the pushing plate, by the means 140 for measuring a difference between the level of the plate for passing the mold and the level of the means for transporting the cope and the drag, by the means 212 for measuring an impact on the plate for receiving a mold, by the means 224 for measuring the temperature of the lower squeeze board, by the means 226 for measuring fouling on the lower squeeze board, by the means 270 for measuring the temperature of the molding sand, by the means 338 for measuring fouling on the means for transporting the cope and the drag, etc. If necessary, it compares them with allowable ranges, to carry out the step of modifying the allowable range or the step of preventing a mold shift, which are discussed below. Incidentally, the "allowable range" is used to evaluate some specific data that has been obtained in the discussion, but a threshold that is a boundary of the allowable range may be used.

Figure 14:
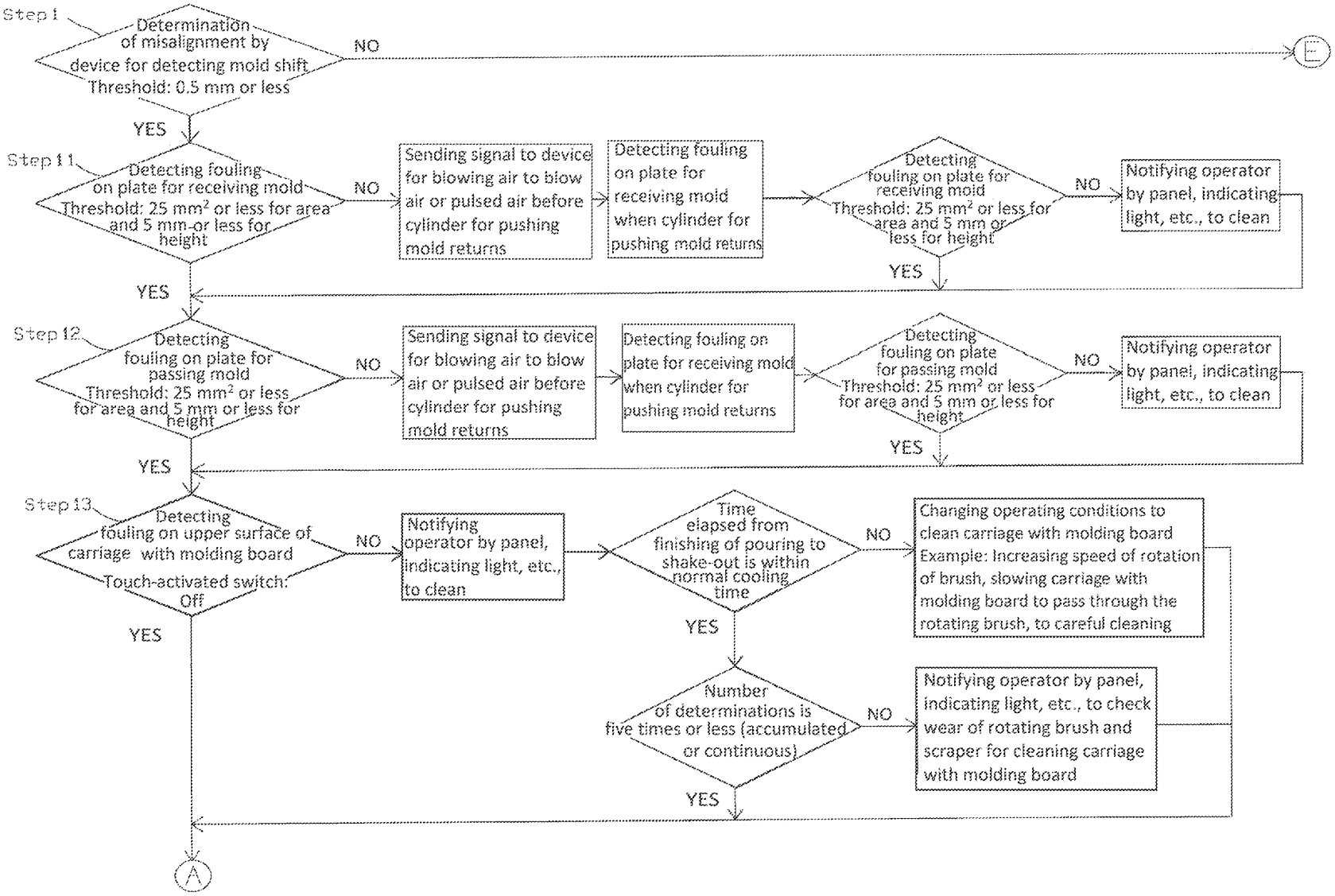
FIG. 14 is a flow diagram of an operation to optimize an allowable range of the specific data (the step of modifying the allowable range). Incidentally, one diagram is shown by being divided into nine diagrams, of (a)-(i).
Figure 14:
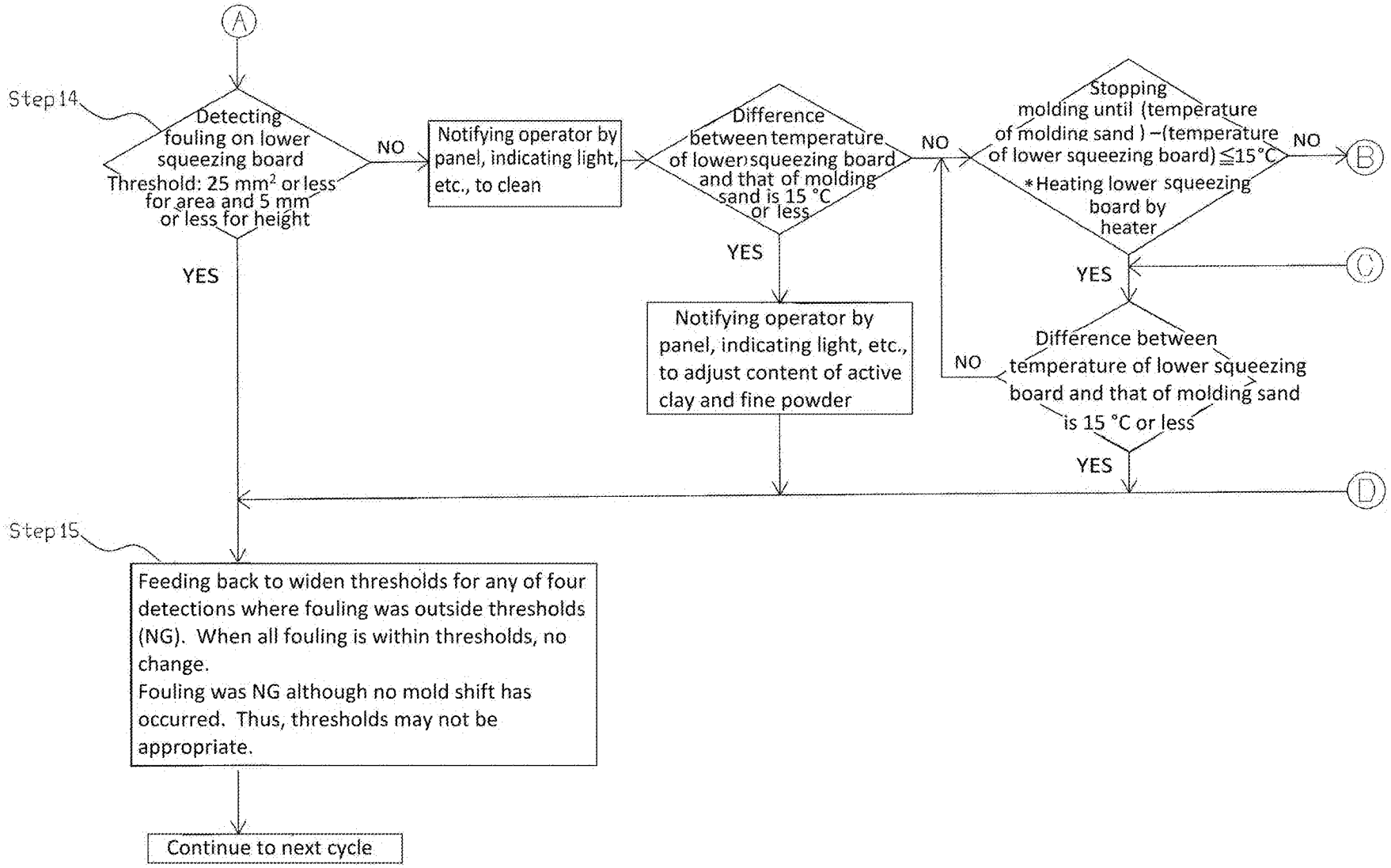
Figure 14:
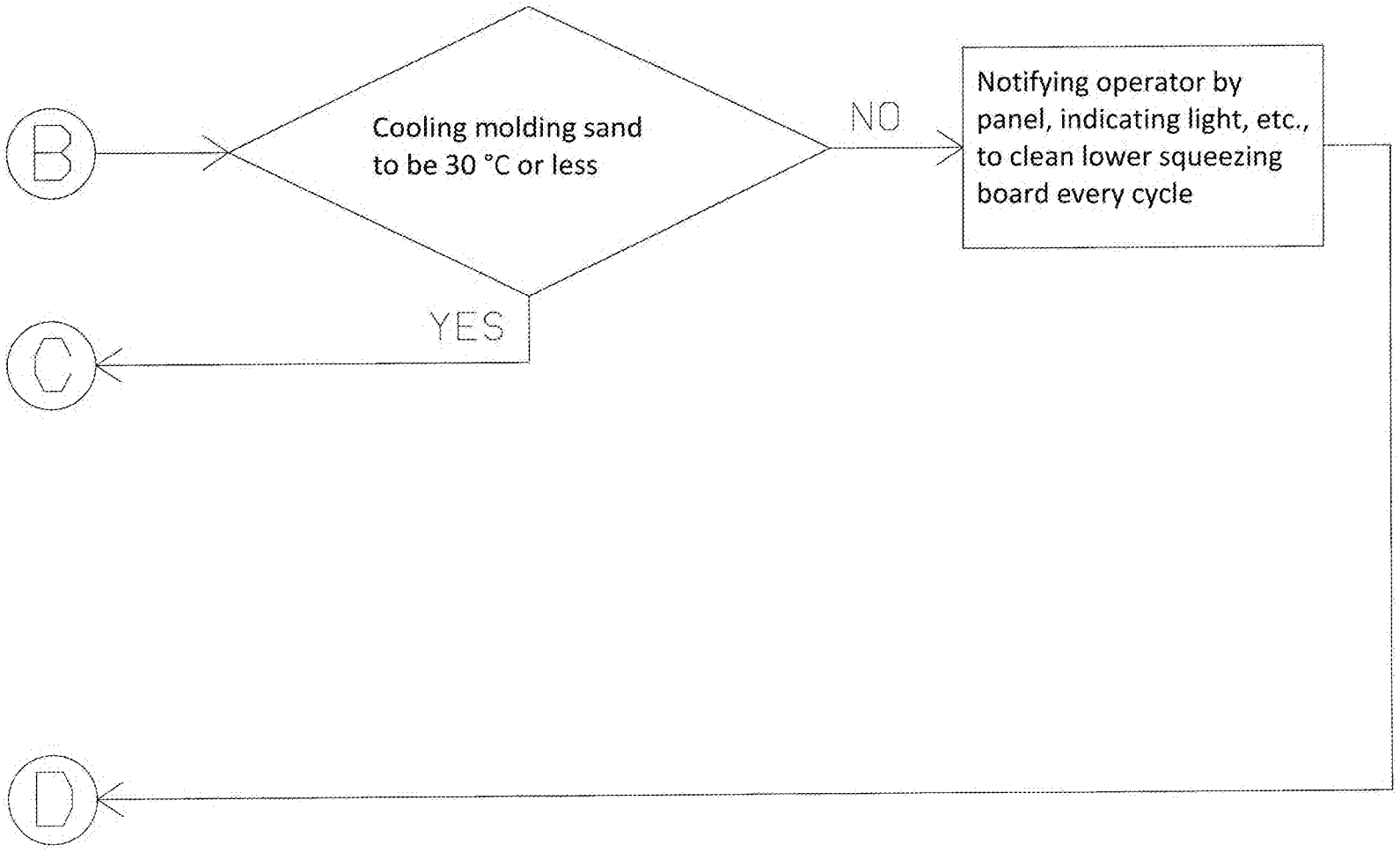
Figure 14:
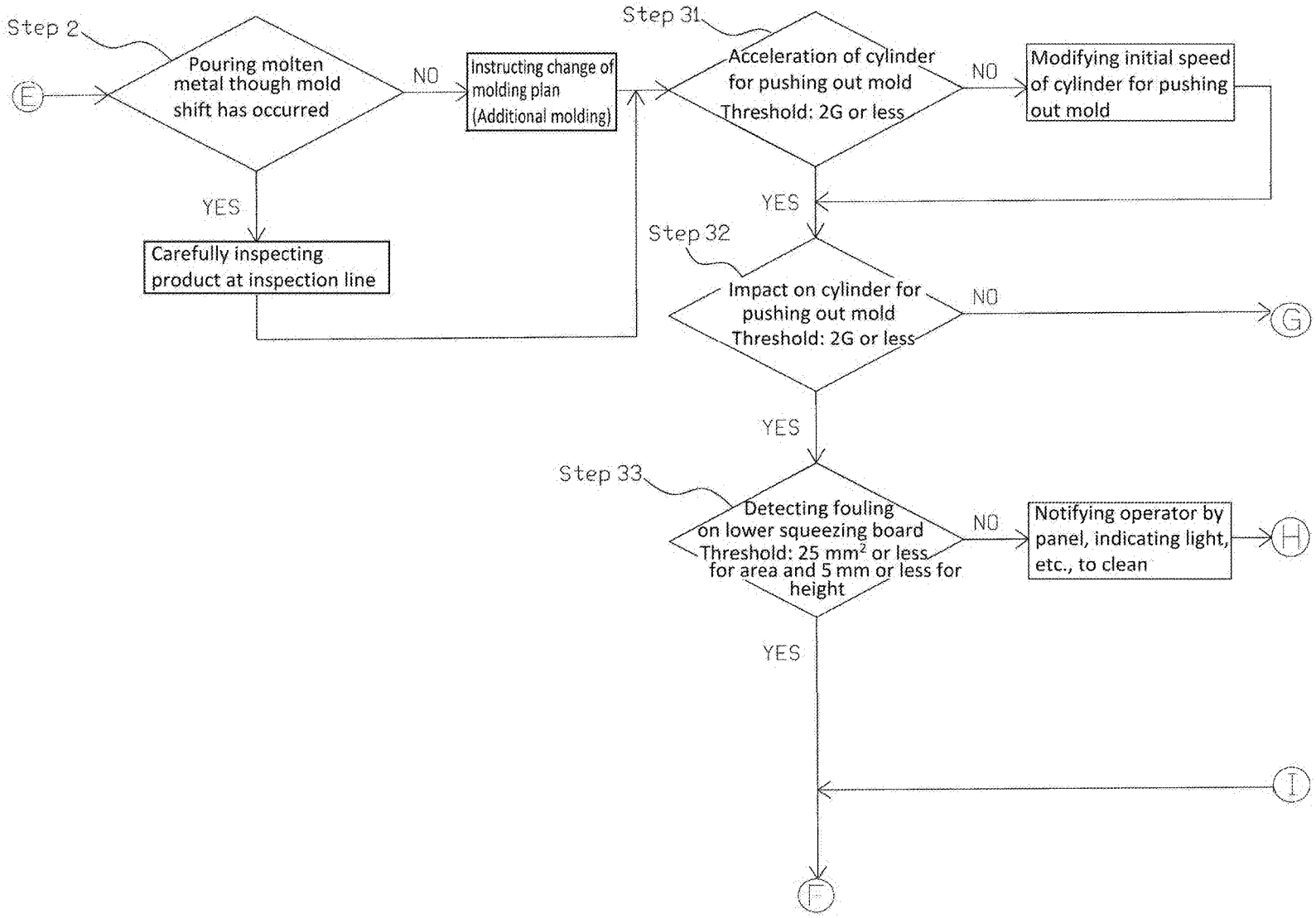
Figure 14:
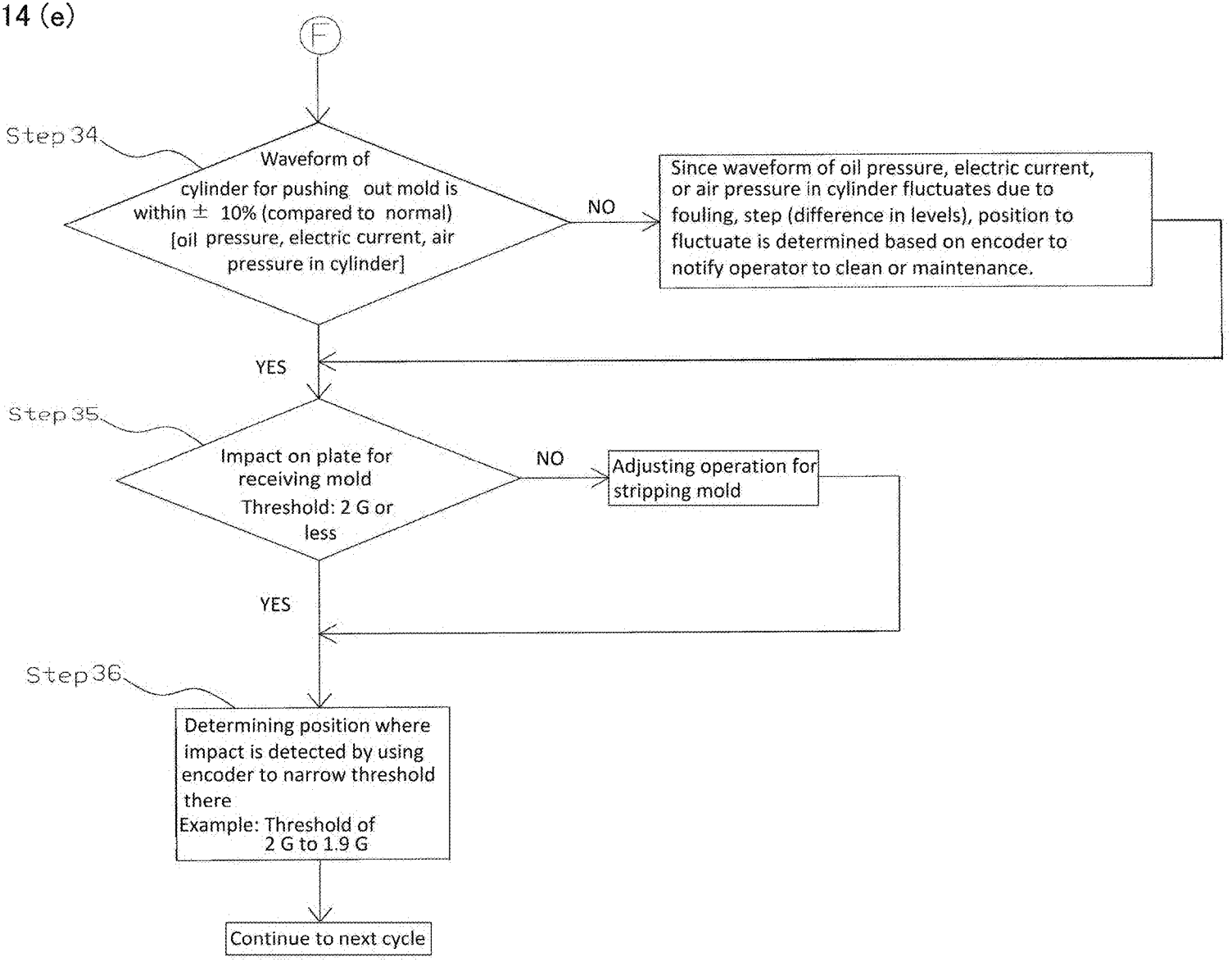
Figure 14:
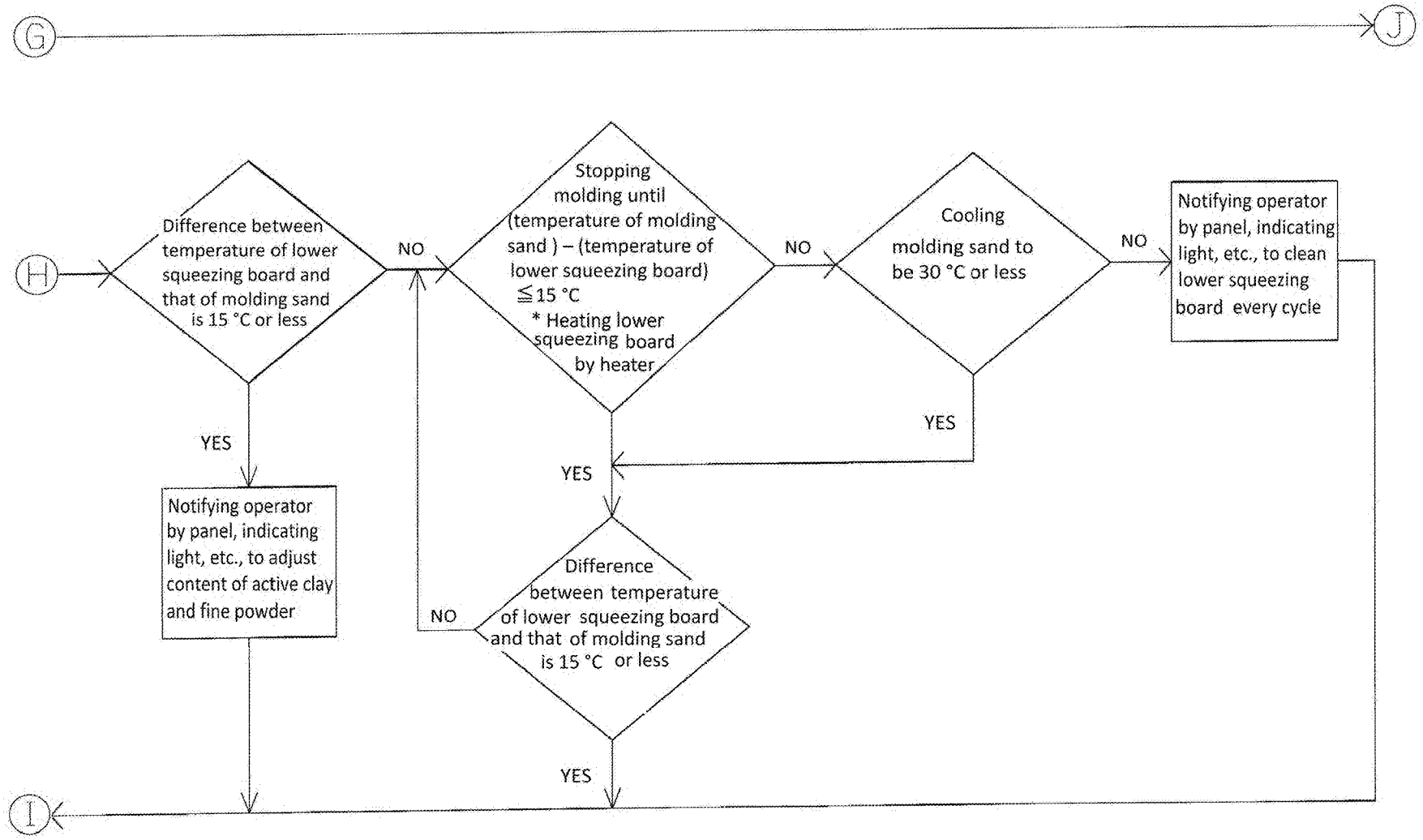
Figure 14:
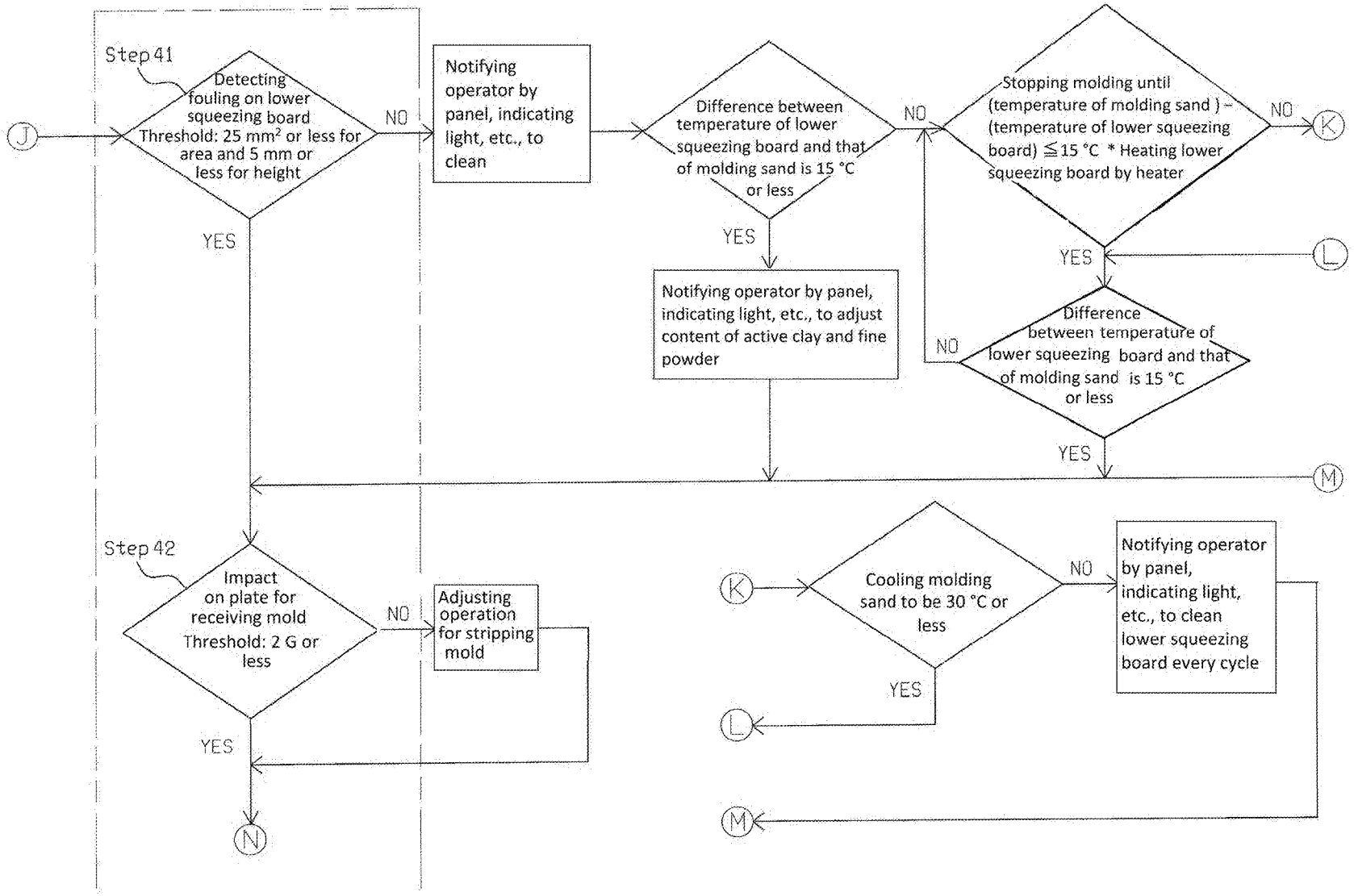
Figure 14:
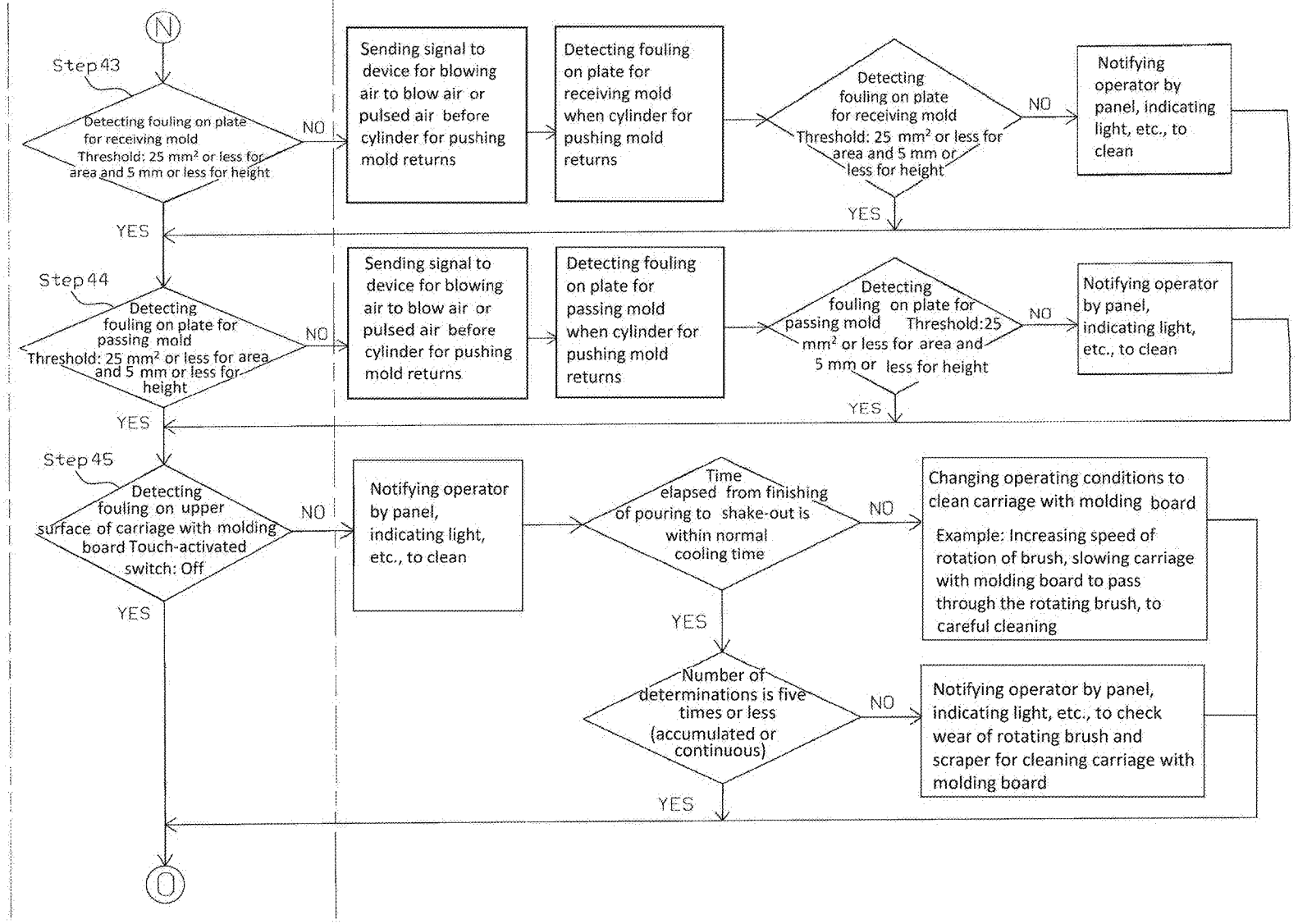
Figure 14:
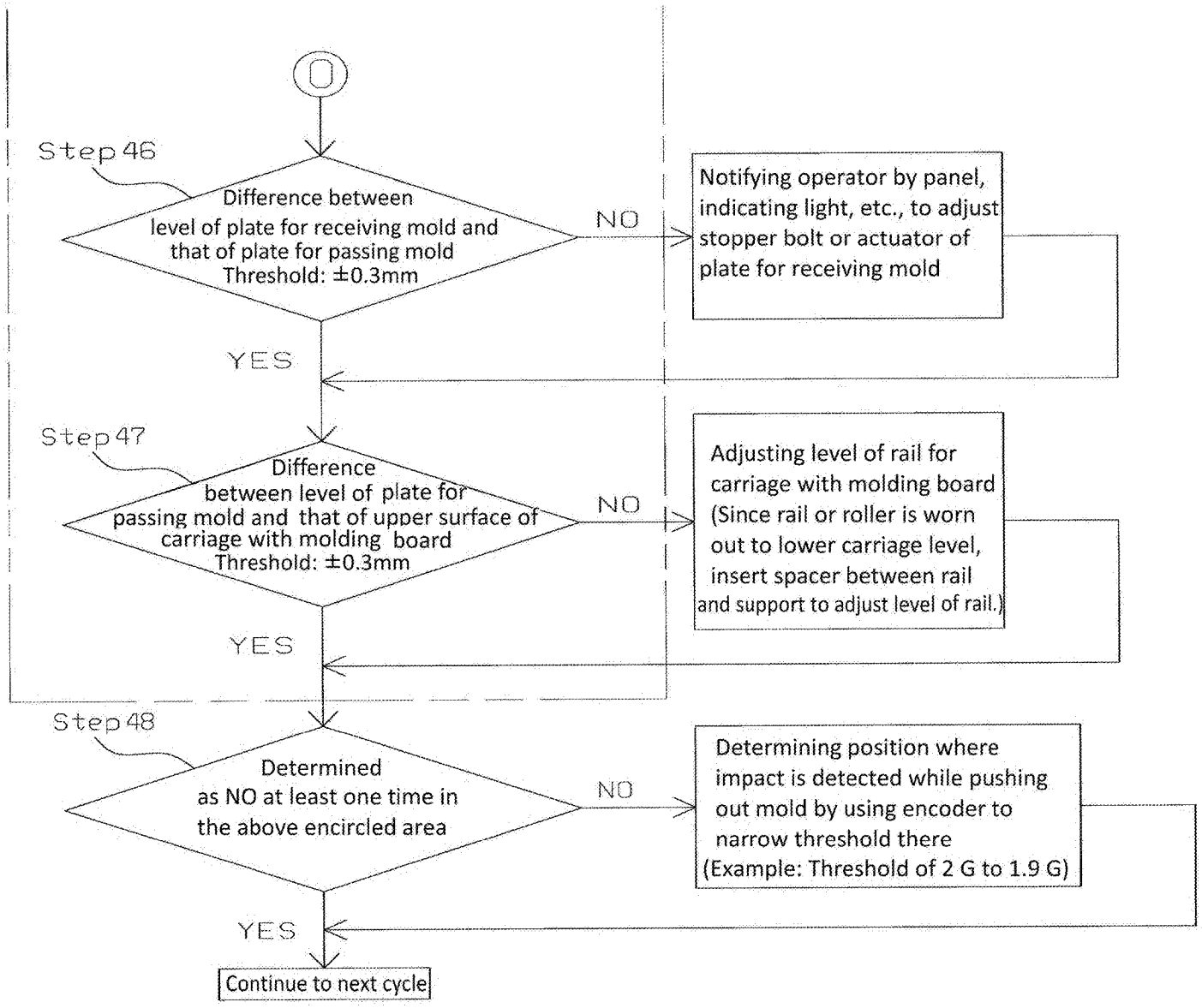
Figure 15:
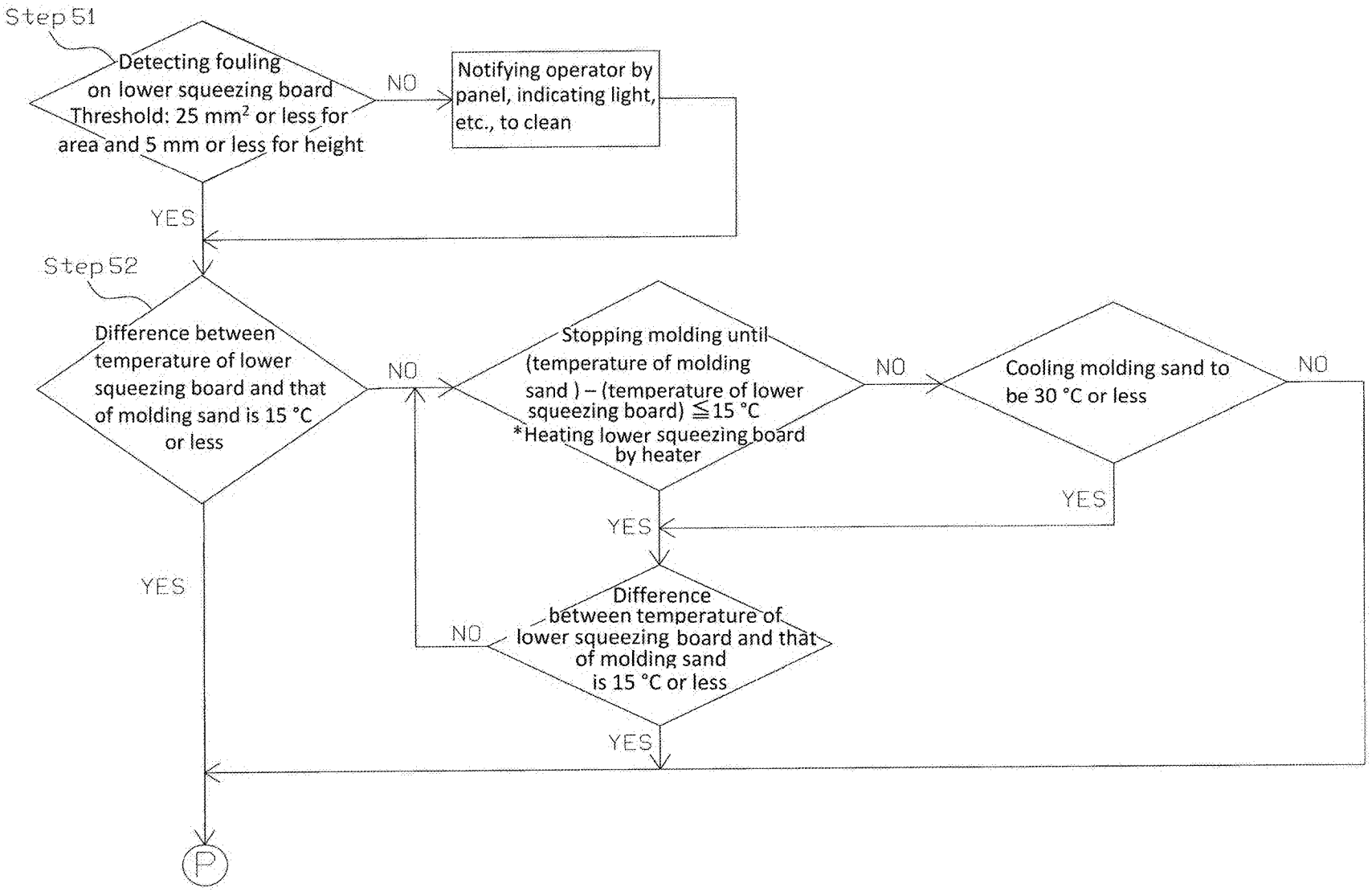
FIG. 15 is a flow diagram of an operation to prevent a mold shift by using the optimized allowable range (the step of preventing a mold shift). Incidentally, one diagram is shown by being divided into five diagrams, of (a)-(e).
Figure 15:
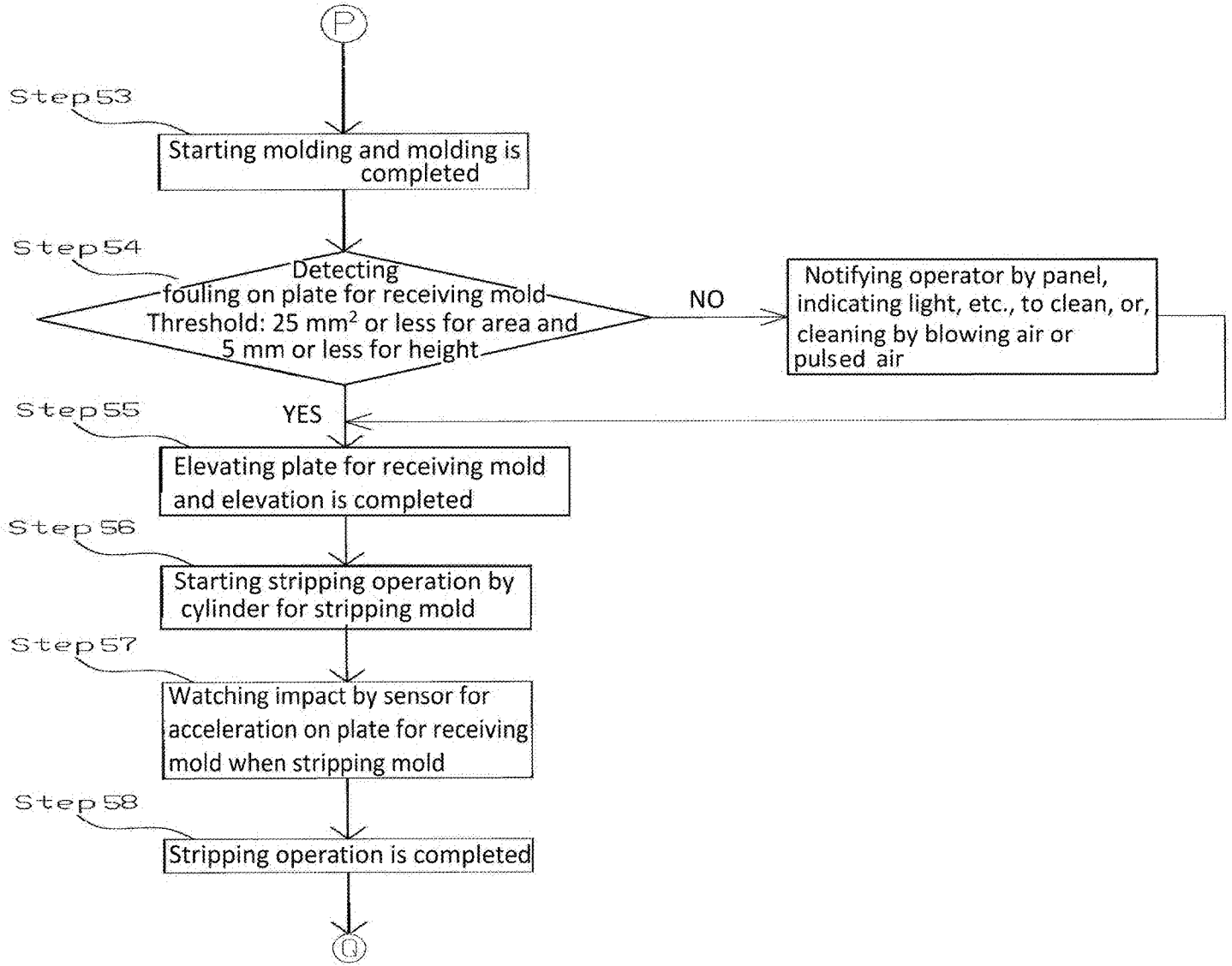
Figure 15:
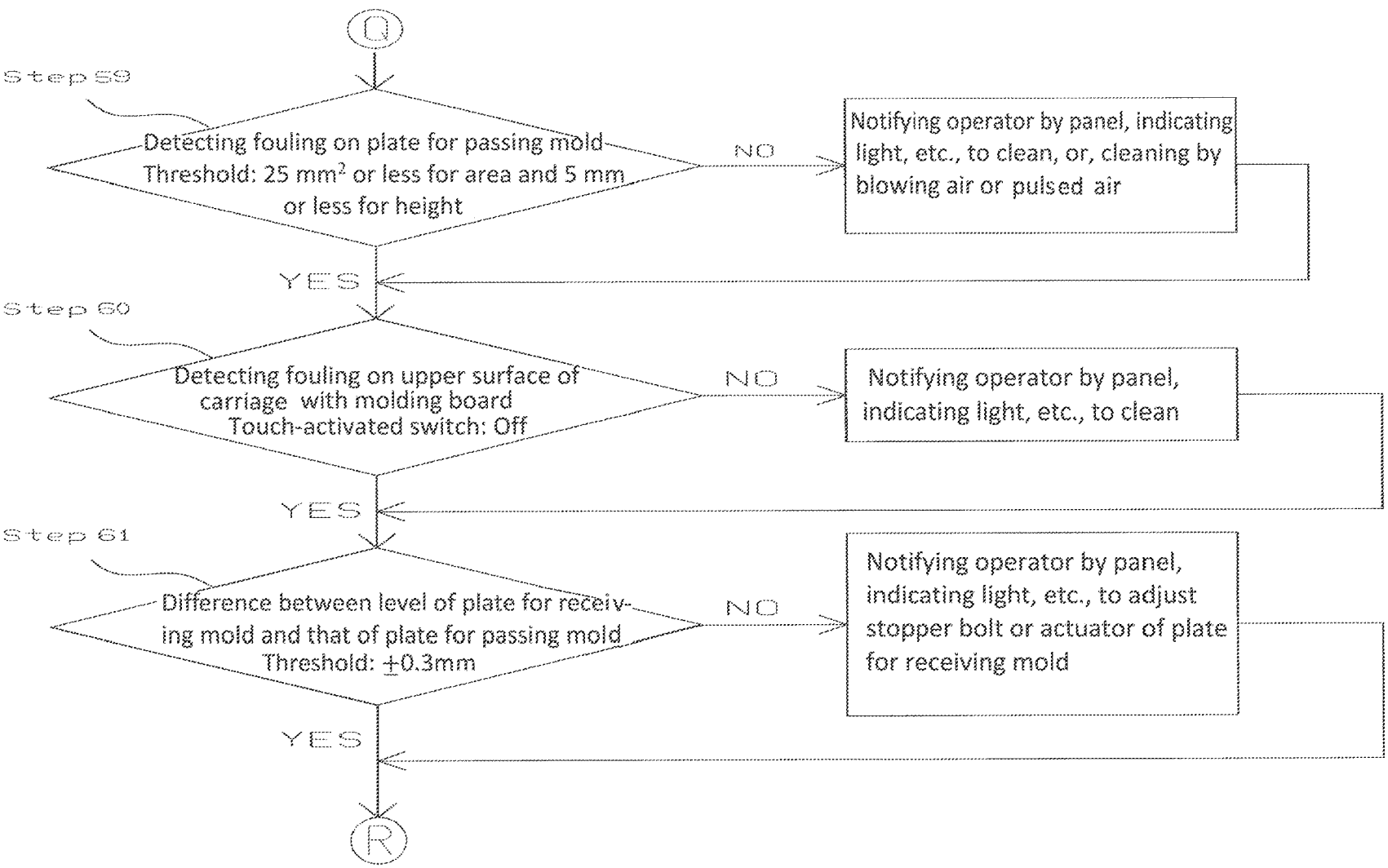
Figure 15:
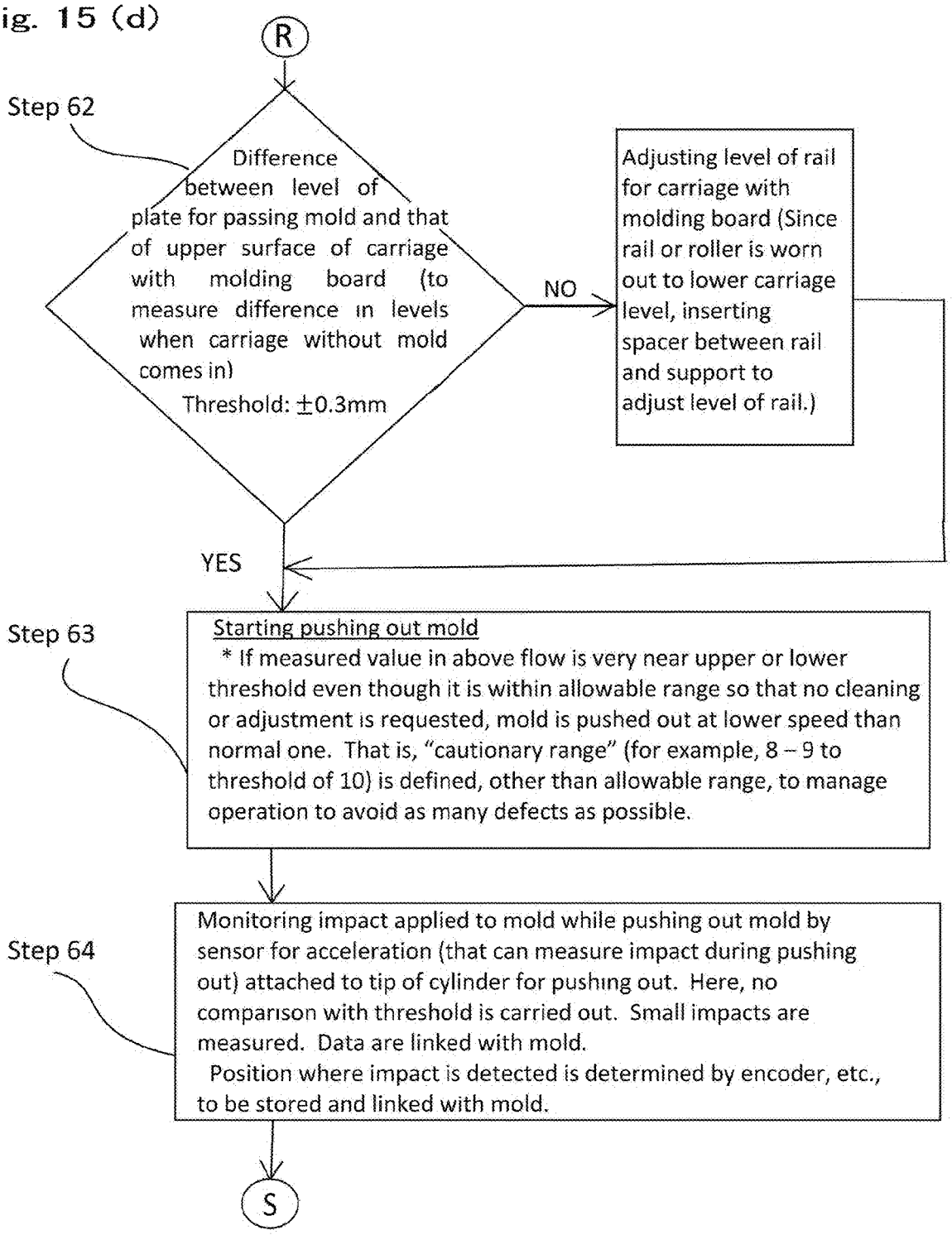
Figure 15:
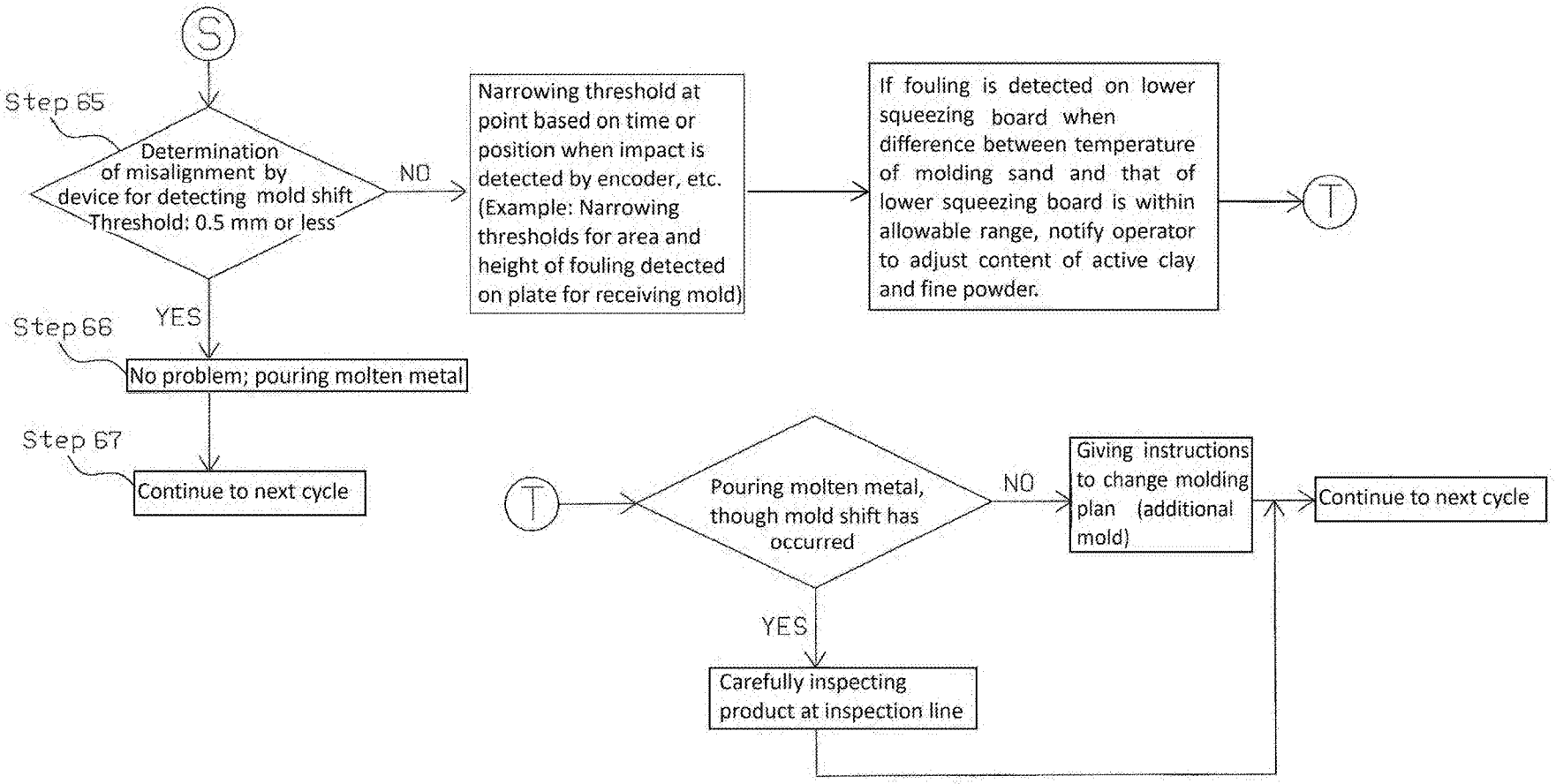
Figure 16:
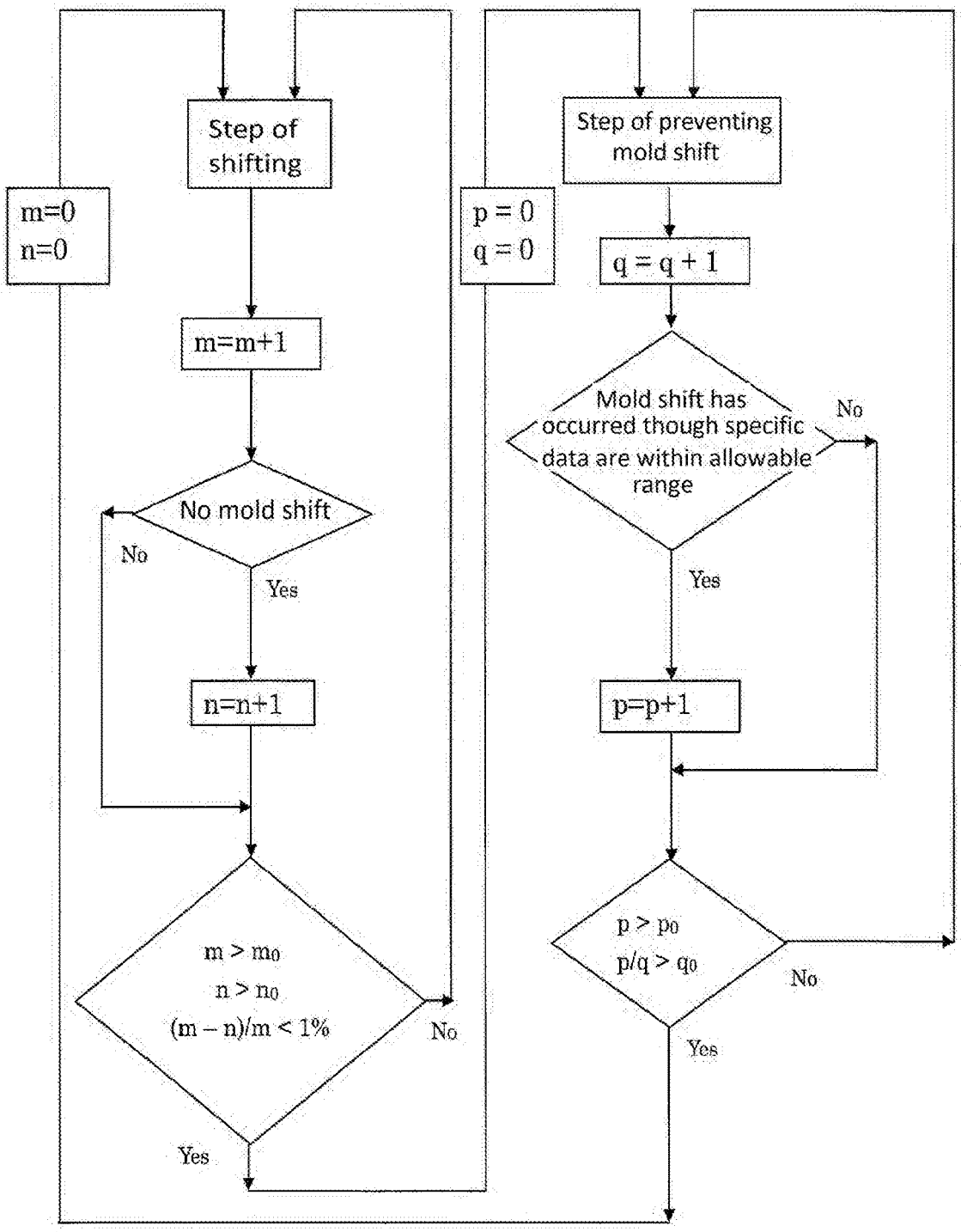
FIG. 16 is a flow diagram that illustrates a shifting between the step of modifying the allowable range and the step of preventing a mold shift.

Next, with additional references to FIGS. 14-16, the operation of the flaskless molding line 100 is now discussed. As in FIG. 3, by the flaskless molding line 100 the cope 1 and the drag 2 that have been molded by the flaskless molding machine 200 and assembled are transported by the means 300 for transporting the cope and the drag. The cope 1 and the drag 2 are pushed by the cylinder 120 for pushing out the mold to be transported to be placed on the carriage 310 with the molding board of the means 300 for transporting the cope and the drag via the plate 210 for receiving the mold and the plate 110 for passing the mold of the flaskless molding machine 200. The carriage with the molding board on which the cope 1 and drag 2 are placed is intermittently transported by a pitch by means of the pusher 390, the cushion 391, and the traverser 392, to sequentially transport the cope 1 and the drag 2. The cope 1 and the drag 2 that are transported by the means 300 for transporting the cope and the drag are first checked to see if a mold shift has occurred, by means of the device 3 for detecting a mold shift. Next, a jacket is placed on the cope 1 and the drag 2 by means of the device 400 for transferring the jacket and the weight. Further, a weight is placed on them. Next, molten metal is poured into them by the pouring machine 800. The cope 1 and the drag 2, into which molten metal has been poured, take a long time to be transported a long distance on the means 300 for transporting the cope and the drag, so that the molten metal is cooled, to be solidified. When the molten metal becomes a casting by being cooled and solidified the weight and the jacket are removed from the cope 1 and the drag 2 by means of the device 400 for transferring the jacket and the weight. Then, the casting is shaken out by the shake-out machine 500. That is, the cope 1 and the drag 2 are broken and the casting is taken out. The molding sand that is generated by breaking the cope 1 and the drag 2 is supplied to the flaskless molding machine 200 via a device for reclaiming molding sand (not shown), a kneader (not shown), etc. In the carriage 310 with the molding board from which the cope 1 and the drag 2 have been removed by the shake-out machine 500 sand that adheres to the groove and the upper surface is removed by means of the scraper 330 and the cleaning means 360. The carriage 310 with the molding board again receives the cope 1 and the drag 2 from the flaskless molding machine 200.

FIG. 14 is a flowchart of the step of modifying the allowable range, i.e., an operation to optimize the allowable range for use with the specific data while causes for a mold shift are eliminated. Incidentally, one flowchart is divided into 9 sheets, (a)-(i). The connecting points are shown by using the encircled letters of A-O. The portion shown by FIGS. 14(*a*)-14(*c*) is a flowchart showing when the device 3 for detecting a mold shift has determined that no mold shift has occurred. First, at Step 1, determining, for example, that the allowable range of a misalignment (a misalignment at a corner) of the cope 1 and the drag 2 for a mold shift is 0.5 mm or less, the misalignments at the corners are evaluated to see if they are within the allowable range.

A determination that a mold shift has occurred can be carried out as follows. For the cope 1, the distance S1 to the point 1*a*, the distance S2 to the point 1*b*, and the distance S3 to the point 1*c*, are measured by the first means 4 for measuring the distance, the second means 5 for measuring the distance, and the third means 6 for measuring the distance, respectively. The position of the center and the angle of rotation of the cope 1 are calculated based on the measured distances S1, S2, S3.

Next, the device 3 for detecting a mold shift is lowered by a cylinder for moving up and down, which is not shown. Then, for the drag 2, the distance S4 to the point 2*a*, the distance S5 to the point 2*b*, and the distance S6 to the point 2*c*, are measured by the first means 4 for measuring the distance, the second means 5 for measuring the distance, and the third means 6 for measuring the distance, respectively. The measurements up to this measurement are carried out while the cope 1 and the drag 2 stop during the intermittent transportation. The position of the center and the angle of rotation of the drag 2 are calculated based on the measured distances S4, S5, S6.

Next, the coordinates of the four corners of the rectangles are calculated based on the positions of the centers and the angles of rotations of the cope 1 and the drag 2. The horizontal distances between the four corresponding corners of the cope 1 and the drag 2 are calculated. In this embodiment, the allowable range for the horizontal distances is 0.5 mm or less. Thus, the allowance is 0-0.5 mm. The distances of the four corners are checked to see if they are within the allowable range to determine if a mold shift has occurred. In this embodiment, if the distance of any one of the four corners is over the allowable range, a mold shift is determined to have occurred. However, if the distances of two corners, three corners, or all four corners, are over the allowable range, a mold shift may be determined to have occurred. Alternatively, if the mean value or root-sum-square value of the distances of the four corners is over the allowable range, a mold shift may be determined to have occurred. Alternatively, a mold shift may be determined to have occurred by using the distances between the centers and the difference between the angles of rotations.

For the cope 1 and the drag 2 in which no mold shift has been determined to have occurred, the size (the area and the height) of fouling on the plate 210 for receiving the mold that the cope 1 and the drag 2 have passed is measured by the two-dimensional laser-type displacement sensor 124 that is attached to the pushing plate 122, which sensor is the means for measuring fouling on the plate for receiving the mold. At Step 11, the specific data on the size is compared with the allowable range. For example, at first the allowable range is determined to be 25 $mm^2$ or less for the area and 5 mm or less for the height. If the measured values are within the allowable range, go to Step 12 (downward in the flowchart) without any change. In this embodiment when both the area and the height are within the allowable range, the size of the fouling is determined to be within the allowable range. However, this is not essential. If the obtained data are outside the allowable range, air is blown out by the device 160 for blowing air to remove fouling on the plate 210 for receiving the mold. On the returning movement of the cylinder 120 for pushing out the mold (contracting the cylinder), fouling on the plate 210 for receiving the mold is measured. If the fouling remains on the returning movement (the obtained data are outside the allowable range), notify an operator by using a panel, an indicating light, etc. That is, since the fouling cannot be cleaned by only blowing air, an operator is requested to clean the plate 210 for receiving the mold. Then, go to Step 12.

At the next step, Step 12, the data on fouling on the plate 110 for passing the mold, i.e., the size (the area and the height) of fouling as the specific data, are compared with the allowable range. The data on the plate 110 for passing the mold through which the cope 1 and the drag 2 have passed are obtained by the two-dimensional laser-type displacement sensor 124, which is the means for measuring fouling on the plate for passing the mold, which sensor is attached to the pushing plate 122. For example, at first the allowable range is determined as 25 $mm^2$ or less for the area and 5 mm or less for the height. If the measured values are within the allowable range, go to Step 13 (downward in the flowchart) without any change. If the obtained data are outside the allowable range, air is blown out by the device 160 for blowing air to remove fouling on the plate 110 for passing the mold. On the returning movement of the cylinder 120 for pushing out the mold (contracting the cylinder) fouling on the plate 110 for passing the mold is measured. If the fouling remains on the returning movement (the obtained data are outside the allowable range), notify an operator by using a panel, an indicating light, etc. That is, since the fouling cannot be cleaned by only blowing air, an operator is requested to clean the plate 110 for passing the mold. Then, go to Step 13.

At the next step, Step 13, fouling on the carriage 310 with the molding board, as the specific data, is measured by the touch-activated switch 338 of the scraper 330, as the means for measuring fouling on the means for transporting the cope and the drag, to see if fouling exists. If no fouling exists (if the touch-activated switch 338 is off), go to Step 14 (downward in the flowchart) without any change. If fouling exists (if the touch-activated switch 338 is on), notify an operator by using a panel, an indicating light, etc., and request that he or she clean the carriage 310 with the molding board, since the fouling remains after cleaning by the scraper 330 or the cleaning means 360. Incidentally, imaging the upper surface of the carriage 310 with the molding board after cleaning may be used to see if fouling exists.

If fouling exists, the time that has elapsed from the finishing of the pouring to the shake-out is determined to see if it is within the normal cooling time. The fouling, i.e., molding sand, hardens over time. However, if the elapsed time is within the normal cooling time, it can be removed by the scraper 330 and the cleaning means 360. Thus, if the fouling cannot be removed even when the elapsed time is within the normal cooling time, the scraper 330 and the cleaning means 360 are estimated to have deteriorated. For example, if the number of determinations that the fouling cannot be removed even when the elapsed time is within the normal cooling time accumulates, or continuously accumulates to reach five or more times, then notify an operator by using a panel, an indicating light, etc., and request that she or he check the wear of the scraper 330 and the cleaning means 360. If the time that has elapsed from the finishing of the pouring to the shake-out is not within the normal cooling time, for example, being left uncontrolled from a closing time to a starting time of the plant, the operating condition of the scraper 330 has changed, since the fouling has probably hardened. Above, the scraper 330 has been discussed. However, for the cleaning means 360 the speed that the rotating brush 370 rotates may be increased, or the speed of the carriage 310 with the molding board to pass the cleaning means 360 may be decreased. Then go to Step 14.

At the next step, Step 14, the data on fouling on the lower squeezing board 220 that have been obtained by the means 226 for measuring fouling on the lower squeeze board, i.e., the size (the area and the height) of fouling as the specific data, are compared with the allowable range. For example, at first the allowable range is determined as 25 $mm^2$ or less for the area and 5 mm or less for the height. If the measured values are within the allowable range, go to Step 15 (downward in the flowchart) without any change. If the obtained data are outside the allowable range, notify an operator by using a panel, an indicating light, etc., and request that she or he clean the lower squeezing board 220.

If the obtained data are outside the allowable range, a difference between the temperature of the lower squeezing board 220 measured by the thermometer 224 and the temperature of the molding sand (sand for molding) 290 measured by the device 270 for automatically measuring the properties of the molding sand, as the specific data, is determined to see if it is within the allowable range. For example, the allowable range may be determined to be 15° C. or less. When the difference between the temperature of the molding sand 290 and that of the lower squeezing board 220 becomes large, dew may be formed on the surface of the lower squeezing board 220 so that the molding sand 290 easily adheres to the surface. Thus, the difference between the temperature of the molding sand 290 and that of the lower squeezing board 220 is determined to see if it is within the allowable range. If it is within the allowable range, then the molding sand 290 adheres to the lower squeezing board 220 without dew. Thus, notify an operator by using a panel, an indicating light, etc., and request that she or he adjust the content of the molding sand 290, such as active clay and fine powder.

If the difference in temperatures is outside the allowable range, it is determined that molding should be stopped until the difference becomes within the allowable range. If it is determined that the molding be stopped, heat the lower squeezing board 220 by a heater 222 to cause the difference to be within the allowable range. If it becomes within the allowable range, go to Step 15. If molding is not stopped and if the lower squeezing board 220 is not heated by the heater 222, the molding sand 290 is cooled to be, for example, 30° C. or lower, for example, by blowing cooled air toward it. If the temperature of the molding sand 290 reaches the set value or becomes below the set value, return to the step of determining if the difference in temperature is within the allowable range. If the lower squeezing board 220 is not heated by the heater 222 and if the molding sand 290 is not cooled, notify an operator by using a panel, an indicating light, etc., to request that the operator clean the lower squeezing board 220 every cycle. Then, go to Step 15.

At the next step, Step 15, the allowable range is widened for items where fouling has been determined to be outside the allowable range at Step 11-Step 14 or where fouling has been determined to exist, even when no mold shift is determined to have occurred. That is, when no mold shift occurs although fouling that is outside the allowable range exists, the allowable range may be inappropriate. For example, say the allowable range is increased by 10%. In this way, by feeding back a result of the determination on a mold shift, the allowable range can be optimized.

At Step 15, if all data on fouling are within the allowable range, no action is carried out. After Step 15 is finished, return to Step 1 for the next cope 1 and drag 2.

If a mold shift is determined to have occurred at Step 1, go to Step 2, which is shown in FIG. 14(*d*). At Step 2, it is determined if molten metal is poured into the mold even when a mold shift has occurred. Normally, this determination is done by an operator and is input in the controller 700. Incidentally, the controller 700 may automatically determine if molten metal is to be poured. If molten metal is then poured, then an instruction is given to carefully check the product on an inspection line. If it has not been poured, an instruction to change a molding plan is given, since an additional cope 1 and drag 2 must be molded. Then go to a step of determining a cause for a mold shift and removing it.

Next, Steps 31-36 as in FIGS. 14(*d*)-(*f*) are carried out to determine a cause for a mold shift. At Step 31, an acceleration in the direction that the cylinder 120 for pushing out the mold pushes out the mold, which acceleration is measured by the means 128 for measuring an impact on the pushing plate, is determined to see if it is within the allowable range. The measured acceleration is the acceleration in the X-direction of elongation and contraction of the cylinder 120 for pushing out the mold. The allowable range is, for example, 2G or less (G: the acceleration of gravity). If the acceleration of the cylinder 120 for pushing out the mold is within the allowable range, go to the next step, Step 32 (downward in the flowchart). If it is outside the allowable range, a set value of the initial velocity to drive the cylinder 120 for pushing out the mold is modified. Then, go to Step 32.

At Step 32, impacts on the pushing plate 122 that have been measured by the means 128 for measuring an impact on the pushing plate are determined to see if they are within the allowable range. The measured impacts are impacts in the direction of elongation and contraction of the cylinder 120 for pushing out the mold (the X-direction) and the vertical direction (the Z-direction). Since the means 128 for measuring an impact on the pushing plate that is used at Step 31 is a three-dimensional acceleration sensor, it can be used for measuring the impacts in the X- and Z-directions. If fouling exists on the plate 210 for receiving the mold or the plate 110 for passing the mold on which the cope 1 and the drag 2 are pushed out, or if there is a difference between the level of the plate 210 for receiving the mold and that of the plate 110 for passing the mold or between that of the plate 110 for passing the mold and that of the carriage 310 with the molding board, the cope 1 and the drag 2 receive an impact when they pass over the fouling or the difference in the levels. That impact is transmitted to the pushing plate 122. The impact remarkably appears in the direction for pushing out (the X-direction) and the vertical direction (the Z-direction). Thus, the impacts on the pushing plate 122 show a possibility that fouling exists on the plate 210 for receiving the mold or the plate 110 for passing the mold or a possibility that there is a difference in the levels. The allowable range is, for example, 2G or less. If both impacts on the pushing plate 122 in the X- and Z-directions are within the allowable range, go to the next step, Step 33 (downward in the flowchart). If at least one of the impacts on the pushing plate 122 is outside the allowable range, go to Steps 41-48 as in FIGS. 14 (*g*)-(*i*). Steps 41-48 are discussed below. Incidentally, an impact in the Y-direction may be measured so as to be compared with the allowable range.

At Step 33, the size of fouling on the lower squeezing board 220 is determined to see if it is within the allowable range. If it is within the allowable range, go to the next step, Step 34 (downward in the flowchart). The determination at Step 33 is carried out in a similar way as discussed at Step 14. If it is outside the allowable range, a procedure that is similar to the procedure that is discussed at Step 14 is carried out. Then, go to Step 34.

At Step 34, a waveform of a fluid pressure that drives the cylinder 120 for pushing out the mold, which waveform is measured by the means 126 for measuring a waveform of the cylinder for pushing out a mold, is determined to see if it is within the allowable range. For example, if the fluctuation in the waveform of the fluid pressure during the transportation of the cope 1 and the drag 2 is within ±10% of the normal waveform, it is within the allowable range. If it is within the allowable range, go to the next step, Step 35 (downward in the flowchart). If fouling exists on the plate 210 for receiving the mold or the plate 110 for passing the mold or if there is a difference between the level of the plate 210 for receiving the mold and that of the plate 110 for passing the mold or between that of the plate 110 for passing the mold and that of the carriage 310 with the molding board, a resistance against pushing out the cope 1 and the drag 2 that differs from that at a normal operation occurs. Thus, the fluid pressure fluctuates. Thus, if the waveform of the fluid pressure is outside the allowable range, it is assumed that fouling or a difference in the levels exists at the position that is calculated by the encoder 130. So an operator must be notified and requested to clean or carry out maintenance. Then, go to the next step, Step 35. Incidentally, when the elongation and contraction of the cylinder 120 for pushing out the mold is an electric type, the waveform of the current is measured instead of the waveform of the fluid pressure.

When it is an air-pressure type, the waveform of the air pressure in the cylinder 120 for pushing out the mold is measured.

At Step 35, the impact applied to the plate 210 for receiving the mold, which impact has been measured by the means 212 for measuring an impact on the plate for receiving a mold, is determined to see if it is within the allowable range. Here, the impact is a vertical impact (the Z-direction). For example, the allowable range is 2G or less. If the impact is within the allowable range, go to the next step, Step 36 (downward in the flowchart). As discussed with reference to FIG. 8(*a*), if the cope 1 and the drag 2 were pushed out by the cylinder 230 for stripping the mold through the plate 232 for pushing the mold before the plate 210 for receiving the mold contacts the cope 1 and the drag 2, then the cope 1 and the drag 2 would drop on the plate 210 for receiving the mold to apply an impact to the cope 1 and the drag 2. Thus, a mold shift may readily occur. So, if the impact applied to the plate 210 for receiving the mold is outside the allowable range, the operation for stripping the cope and the drag from the flasks is modified. Specifically, the timing to operate the cylinder 218 for the plate for receiving the mold and the cylinder 230 for stripping the mold is automatically or manually modified, so that the plate 232 for pushing the mold contacts the cope 1 to push out the cope 1 and the drag 2 after the plate 210 for receiving the mold has definitely contacted the drag 2. Then, go to the next step, Step 36.

At Step 36, the position where the impact was detected, or the waveform of the fluid pressure was within the allowable range but was large at Step 31, Step 32, or Step 34, is calculated by the encoder 130 so that the allowable range at that position is narrowed. That is, if that position is the plate 210 for receiving the mold, the allowable range for the size of fouling on the plate 210 for receiving the mold is narrowed. If that position is the step between the plate 210 for receiving the mold and the plate 110 for passing the mold, the allowable range for the difference in their levels is narrowed. If that position is the plate 110 for passing the mold, the allowable range for the size of fouling on the plate 110 for passing the mold is narrowed. If that position is the step between the plate 110 for passing the mold and the carriage 310 with the molding board, the allowable range for the difference in their levels is narrowed. For example, at Step 31 the allowable range is narrowed from 2G or less to 1.9 G or less. Here, the impact or the waveform is regarded as being large when it is, for example, 80% or more, or 90% or more, of the allowable range. Alternatively, it may be the value that has the highest ratio of the obtained specific data to the allowable range. After Step 36, return to Step 1 for checking the next cope 1 and drag 2.

Next, with reference to FIGS. 14 (*g*)-(*i*), Steps 41-48 are discussed. They are carried out when the impacts on the cylinder 120 for pushing out the mold in the X- and Z-directions at Step 32 are outside the allowable range. At Step 41, if the size of the fouling on the lower squeezing board 220 is within the allowable range, go to Step 42 (downward in the flowchart). If that size is outside the allowable range, the process that is discussed at Step 14 is carried out. Then, go to Step 42.

At Step 42, the impact on the plate 210 for receiving the mold is determined to see if it is within the allowable range. If it is within the allowable range, go to the next step, Step 43 (downward in the flowchart). If it is outside the allowable range, the operation for stripping the cope and the drag from the flasks is adjusted. Then, go to Step 43. Since at Step 42 the process that is the same as that at Step 35 is carried out, a duplicate discussion is omitted.

At Step 43, the size of the fouling on the plate 210 for receiving the mold is determined to see if it is within the allowable range as at Step 11. If it is within the allowable range, go to the next step, Step 44 (downward in the flowchart). If it is outside the allowable range, the process that is discussed at Step 11 is carried out. Then go to the next step, Step 44.

At Step 44, the size of the fouling on the plate 110 for passing the mold is determined to see if it is within the allowable range as at Step 12. If it is within the allowable range, go to the next step, Step 45 (downward in the flowchart). If it is outside the allowable range, the process that is discussed at Step 12 is carried out. Then go to the next step, Step 45.

At Step 45, it is determined if fouling on the carriage 310 with the molding board exists, as at Step 13. If no fouling exists, go to the next step, Step 46 (downward in the flowchart). If fouling exists, the process that is discussed at Step 13 is carried out. Then go to the next step, Step 46. Incidentally, similar to Step 13, an image recognition of the upper surface of the carriage 310 with the molding board after cleaning may be used to see if fouling exists.

At Step 46, the difference between the level of the plate 210 for receiving the mold and that of the plate 110 for passing the mold that has been measured by the means 124 for measuring a difference between the level of the plate for receiving the mold and the level of the plate for passing the mold is determined to see if it is within the allowable range. For example, the allowable range may be ±0.3 mm or less. If the difference is within the allowable range, go to the next step, Step 47 (downward in the flowchart). If it is outside the allowable range, notify an operator by using a panel, an indicating light, etc., to adjust the stopper bolt 214 of the plate 210 for receiving the mold, to modify the level of the plate 210 for receiving the mold when it is lowered. Alternatively, the operation of an actuator 218 that vertically moves the plate 210 for receiving the mold may be adjusted. Incidentally, the plate 110 for passing the mold is generally fixed so that its level cannot be adjusted. Then, go to the next step, Step 47. Incidentally, instead of measuring the difference between the level of the plate 210 for receiving the mold and that of the plate 110 for passing the mold by the means 124 for measuring a difference between the level of the plate for receiving the mold and the level of the plate for passing the mold, it may be determined if the difference is within the allowable range by measuring the weight of molding sand that has been shaved off when the cope 1 and the drag 2 are pushed out from the plate 210 for receiving the mold to the plate 110 for passing the mold. That is, when they are pushed over the step, i.e., the difference in the levels, the drag 2 is shaved off by the step so that a part of the molding sand drops through the gap between the plate 210 for receiving the mold and the plate 110 for passing the mold. Such molding sand is collected in a container to be weighed by a load cell, etc., to determine the difference in the levels.

At Step 47, the difference between the level of the plate 110 for passing the mold and that of the carriage 310 with the molding board that has been measured by the means 140 for measuring a difference between the level of the plate for passing the mold and the level of the means for transporting the cope and the drag is determined to see if it is within the allowable range. For example, say the allowable range is ±0.3 mm or less. If the difference is within the allowable range, go to the next step, Step 48 (downward in the flowchart). If it is outside the allowable range, notify an operator by using a panel, an indicating light, etc., to modify the level of the rail 320. The main reason to increase the difference between the level of the plate 110 for passing the mold and that of the carriage 310 with the molding board is that the rollers 312 of the carriage 310 with the molding board or the rail 320 has been worn out after being used for a long time. Thus, for example, a spacer (not shown) is inserted under the rail 320 to modify its level. Then, go to the next step, Step 48. Incidentally, similar to Step 46, instead of measuring the difference between the level of the plate 110 for passing the mold and that of the carriage 310 with the molding board by the means 140 for measuring a difference between the level of the plate for passing the mold and the level of the means for transporting the cope and the drag, it may be determined if the difference is within the allowable range by measuring the weight of molding sand that has been shaved off when the cope 1 and the drag 2 are pushed out from the plate 110 for passing the mold to the carriage 310 with the molding board.

At Step 48, the specific data are determined to see if any part of them is outside the allowable range at Steps 41-44, 46, and 47. If all parts of them are within the allowable range, then, since nevertheless a mold shift has occurred (determined at Step 1), the allowable ranges at the positions where the impact has been measured during pushing out the cope 1 and the drag 2 are to be narrowed. For example, at Step 31 the allowable range of 2 G is narrowed to be 1.9 G. The "positions where the impact has been measured during pushing out the cope 1 and the drag 2" are, for example, on the plate 210 for receiving the mold, on the plate 110 for passing the mold, on the carriage 310 with the molding board, or the step between them. Such a position can be determined by the encoder 130. In this way, by determining a position where a cause of a mold shift may exist and by narrowing the allowable range at that position, the allowable range can be modified to achieve an appropriate range. If at least one part of the specific data is outside the allowable range at any of Steps 41-44, 46, and 47, go to Step 1 for the next cope 1 and drag 2.

Next, with reference to the flowchart in FIG. 15, the operation at the step of preventing a mold shift in the flaskless molding line 100 is discussed wherein the obtained specific data and the allowable ranges that have been modified to be appropriate at the step of modifying the allowable range are used. Incidentally, one flowchart is divided into 5 sheets, (a)-(e). The connecting points are shown by using the encircled letters of P-T.

First, at Step 51, the size of the fouling on the lower squeezing board 220 that has been measured by the means 226 for measuring fouling on the lower squeeze board is determined to see if it is within the allowable range. When the mold of the previous cycle has been squeezed, the flasks 240, 250 (see FIG. 8) rotate by 90°. Thus, the front of the lower squeezing board 220 is open. So, the size of the fouling on the lower squeezing board 220 can be measured by the two-dimensional laser-type displacement sensor 226 or a device for recognizing an image (not shown). Then, based on the size of the fouling, which is the measured specific data, it is determined if cleaning at the current cycle is needed. The allowable range is, for example, 25 $mm^2$ or less for an area and 5 mm or less for a height. However, the allowable range may be modified at the step of modifying the allowable range. If both the area and the height are within the allowable range, go to the next step, Step 52. If either of them is outside the allowable range, then notify an operator by using a panel, an indicating light, etc., to remove the fouling, etc. Then, go to the next step, Step 52.

Next, at Step 52, a difference in the temperature of the lower squeezing board 220 that is measured by the means 224 for measuring the temperature of the lower squeeze board and the temperature of the molding sand 290 that is measured by the means 270 for measuring the temperature of the molding sand is determined to see if it is within the allowable range. The molding sand 290 is conveyed by the conveyor 280, that is, it is to be molded. The allowable range is, for example, 15° C. or less. However, it may be modified at the step of modifying the allowable range. If it is within the allowable range, go to the next step, Step 53 (downward in the flowchart). If it is outside the allowable range, it is determined if molding should be stopped until the difference becomes within the allowable range. If the molding is stopped, the lower squeezing board 220 is heated by the heater 222. When the difference becomes within the allowable range, go to the next step, Step 53. If molding is not stopped and the lower squeezing board 220 is not heated by the heater 222, then, for example, cooling air is blown toward the molding sand 290 so that the temperature of the molding sand 290 becomes, for example, 30° C. or less. When the temperature of the molding sand becomes the set temperature or less, return to the step of determining if the difference in temperatures is within the allowable range. If the lower squeezing board 220 is not heated by the heater 222 and the molding sand 290 is not cooled, go to Step 53. Incidentally, even when the difference between the temperature of the lower squeezing board 220 and that of the molding sand 290 is outside the allowable range, it is possible to go to the next step without any action because of the plan for operating. When molding cannot be stopped due to time constraints, go to the next step even when the fouling may exist on the lower squeezing board 220 when molding the cope 1 and drag 2 at the next cycle. In this case, at Step 51 for the next cycle, the size of the fouling may possibly be outside the allowable range. So an operator should be notified by using a panel, an indicating light, etc., to remove the fouling, etc.

Next, at Step 53, the cope 1 and the drag 2 are molded by the flaskless molding machine 200. After removing the matchplate, the cope 1 and the drag 2 are assembled.

At Step 54, the size of the fouling on the plate 210 for receiving the mold that has been measured by the means 124 for measuring fouling on the plate for receiving the mold is determined to see if it is within the allowable range. Incidentally, at Step 54, the data are used that were obtained when the cylinder 120 for pushing out the mold was caused to contract (in the returning movement) at the previous cycle (the process for the cope 1 and the drag 2 that were molded at the cycle that is previous to the cope 1 and the drag 2 that were molded at Step 53). The allowable range is, for example, 25 $mm^2$ or less for an area and 5 mm or less for a height. However, they may be modified at the step of modifying the allowable range. If it is within the allowable range, go to the next step, Step 55 (downward in the flowchart). If it is outside the allowable range, notify an operator by using a panel, an indicating light, etc., to remove the fouling by blowing air by the device 160 for blowing air or to clean the fouling. Then, go to the next step, Step 55.

At Step 55, the plate 210 for receiving the mold is lifted to contact the bottom of the cope 1 and the drag 2. Next, at Step 56, the cope 1 and the drag 2 in the upper flask 250 and the lower flask 240 are downwardly pushed by the cylinder 230 for stripping the mold through the plate 232 for pushing the mold, to be stripped. At Step 57, the impact that is applied to the plate 210 for receiving the mold when stripping the cope 1 and the drag 2 is measured by the means 212 for measuring an impact on the plate for receiving a mold. When the plate 210 for receiving the mold on which the cope 1 and the drag 2 are placed is lowered to the lowest position, the stripping operation is completed (Step 58). When the stripping operation is completed, go to the next step, Step 59 (downward in the flowchart).

At Step 59 the size of the fouling on the plate 110 for passing the mold is determined to see if it is within the allowable range. The size was measured by the means 124 for measuring fouling on the plate for passing the mold when the cylinder 120 for pushing out the mold was caused to contract at the previous cycle (the process for the cope 1 and the drag 2 that were molded at the cycle that is previous to the cope 1 and the drag 2 that were molded at Step 53). The allowable range is, for example, 25 $mm^2$ or less for an area and 5 mm or less for a height. However, they may be modified at the step of modifying the allowable range. If it is within the allowable range, go to the next step, Step 60 (downward in the flowchart). If it is outside the allowable range, notify an operator by using a panel, an indicating light, etc., to remove the fouling by blowing air by the device 160 for blowing air or to clean the fouling. Then, go to the next step, Step 60.

At Step 60, for example, as in FIGS. 9 and 10, the groove and the upper surface of the carriage 310 with the molding board is cleaned. At that time, the fouling is detected. When the carriage 310 with the molding board is transported below the scraper 330, the existence of fouling is detected when cleaning the groove and the upper surface of the carriage 310 with the molding board (Step 60). If no fouling is detected, go to the next step, Step 61 (downward in the flowchart). If fouling is detected, notify an operator by using a panel, an indicating light, etc., to clean the fouling, etc. Then, go to the next step, Step 61. Incidentally, the existence of fouling is detected when cleaning the groove and the upper surface of the carriage 310 with the molding board. The result may be stored, for example, in a memory of the controller 700 and may be imported when the carriage 310 with the molding board is at the position under the step of pushing out the mold so that the necessity to notify the operator is determined. In the above discussion the fouling on the groove and the upper surface of the carriage 310 with the molding board is detected by the scraper 330, but it may be detected by the cleaning means 360.

At Step 61, the difference between the level of the plate 210 for receiving the mold and that of the plate 110 for passing the mold is determined to see if it is within the allowable range. The difference was measured by the means 124 for measuring a difference between the level of the plate for receiving the mold and the level of the plate for passing the mold when the cylinder 120 for pushing out the mold was caused to contract at the previous cycle (the process for the cope 1 and the drag 2 that were molded at the cycle that is previous to the cope 1 and the drag 2 that were molded at Step 53). The allowable range is, for example, ±0.3 mm or less. However, it may be modified at the step of modifying the allowable range. If it is within the allowable range, go to the next step, Step 62 (downward in the flowchart). If it is outside the allowable range, notify an operator by using a panel, an indicating light, etc., to adjust the stopper bolt 214 of the plate 210 for receiving the mold or the actuator of the plate 210 for receiving the mold, i.e., to adjust the operation of the cylinder 218 for the plate for receiving the mold (see FIG. 8). Then, go to the next step, Step 62.

At Step 62, the difference between the level of the plate 110 for passing the mold and that of the upper surface of the carriage 310 with the molding board is determined to see if it is within the allowable range. The difference has been measured by the means 140 for measuring a difference between the level of the plate for passing the mold and the level of the means for transporting the cope and the drag. The allowable range is, for example, ±0.3 mm or less. However, it may be modified at the step of modifying the allowable range. If it is within the allowable range, go to the next step, Step 63 (downward in the flowchart). If it is outside the allowable range, notify an operator by using an indicating light, etc., to adjust the level of the rail 320 for the carriage 310 with the molding board in a similar way as discussed at Step 47. Then, go to the next step, Step 63.

At Step 63, the cope 1 and the drag 2 are pushed out from the plate 210 for receiving the mold to the carriage 310 with the molding board via the plate 110 for passing the mold by means of the cylinder 120 for pushing out the mold. At that time, if the fouling at Step 54 or 59 or the difference in the levels at Step 61 or 62 is within the allowable range but is near the threshold, it is better to push them out at a speed that is slower than the normal speed, to reduce the possibility of a mold shift of the cope 1 and the drag 2. For example, assume that the allowable range is ten and that the cautionary range is 8-9. If a value is in the cautionary range, the motion of the cylinder 120 for pushing out the mold is slowed.

Next, at Step 64, the impacts (the X-direction and the Z-direction) of the cope 1 and the drag 2 are measured while they are being pushed out. The impacts are measured by the means 128 for measuring an impact on the pushing plate that is attached to the pushing plate 122 at the tip of the cylinder 120 for pushing out the mold. The measured values together with the information on the position that is calculated by the encoder 130 are linked to (associated with) the cope 1 and the drag 2 and recorded at the controller 700.

Next, at Step 65, a mold shift is detected by the device 3 for detecting a mold shift, to see if a mold shift occurs. For example, if a misalignment at any of the four corners exceeds the allowable range, it is determined that a mold shift has occurred. However, this is not essential. It may be determined by another method as discussed at Step 1. The allowable range is, for example, 0.5 mm or less. If it is within the allowable range, the cope 1 and the drag 2 are evaluated as having no problem, and are transported (Step 66), so that molten metal is poured into them. Then proceed to the next cycle (Step 67).

If the misalignment is outside the allowable range, a mold shift is considered to have occurred, so that the allowable range for the specific data is narrowed. At the step of preventing a mold shift, the fouling has been removed and the operator has been notified of the difference in the levels (the step), to eliminate the cause of a mold shift at Step 51, Step 52, Step 54, Step 59, Step 60, Step 61, and Step 62. Nevertheless, a mold shift has occurred. Thus, the allowable range has not been appropriate. So, the position where the impact was measured (the plate 210 for receiving the mold, the step between the plate 210 for receiving the mold and the plate 110 for passing the mold, the plate 110 for passing the mold, or the step between the plate 110 for passing the mold and the carriage 310 with the molding board), is determined. The position where the impact occurred while pushing out the mold can be determined by the encoder 130. Alternatively, for the impact applied to the plate 210 for receiving the mold that has been measured at Step 57, the allowable range for it is narrowed. Further, even when the difference between the temperature of the molding sand 290 and that of the lower squeezing board 220 is within the allowable range, the fouling exists on the lower squeezing board 220. Then, notify an operator by using the indicating light, etc., to request that the content of the active clay and the fine powder of the molding sand 290 be modified. If molten metal is poured into the cope 1 and the drag 2 where a mold shift has occurred, instructions are given to carefully check the product on the inspection line. If it is not poured, instructions to change a molding plan are given, since an additional cope 1 and drag 2 must be molded. Then, go to the next step.

Next, with reference to FIG. 16, shifting is discussed in regards to it being carried out between the step of modifying the allowable range that is discussed with reference to FIG. 14 and the step of preventing a mold shift that is discussed with reference to FIG. 15. First, the step of modifying the allowable range is carried out. Initially, a number m to count the operations of the step of modifying the allowable range is set to be zero (0) and the number n to count non-occurrences of any mold shift is set to be zero (0). When the step of modifying the allowable range is carried out, one (1) is added to the number m to count the operations of the step of modifying the allowable range. If no mold shift occurs at the step of modifying the allowable range, one (1) is added to the number n to count the non-occurrences of a mold shift. Next, it is determined if the number m to count the operations of the step of modifying the allowable range exceeds the set number $m_0$ or if the number n to count non-occurrences of a mold shift exceeds the set number $n_0$. The set number $m_0$ for the number m is, for example, 7,000, which is statistically estimated, so that modification has been completed by accumulating the data. The set number no for the number n is, for example, 100. The number n to count each non-occurrence of a mold shift may be successive numbers. In this case, if the determination on the non-occurrence of a mold shift is "No," the number n to count non-occurrences of a mold shift is set to be zero (0). If the number m to count the operations of the step of modifying the allowable range exceeds the set number $m_0$, if the number n to count non-occurrences of a mold shift exceeds the set number $n_0$, or if both of them exceed the set numbers, the operation is shifted to the step of preventing a mold shift. Alternatively, if the defect ratio that is calculated by the equation, {(the number m to count the operations of the step of modifying the allowable range−the number n to count non-occurrences of a mold shift)/the number m to count the operations of the step of modifying the allowable range}, is equal to, or less than, a set value, the operation may be shifted to the step of preventing a mold shift. The defect ratio is a ratio of the number of cycles where a mold shift occurs to the number of total cycles. For example, if it is less than 1%, the operation is shifted to the step of preventing a mold shift. Not only by the defect ratio, but by combining it with the fact that the number m to count the operations of the step of modifying the allowable range exceeds the set number $m_0$, the operation is preferably shifted to the step of preventing a mold shift.

When the operation is shifted to the step of preventing a mold shift, the number q to count the operations of the step of preventing a mold shift is set to be zero (0). The number p to count the mold shifts even when the obtained data (the specific data) are within the allowable range is set to be zero (0). When the step of preventing a mold shift is carried out, one (1) is added to the number q. If a mold shift occurs even when the obtained data are within the allowable range at the step of preventing a mold shift, one (1) is added to the number p. If the number p exceeds the set number $p_0$ or if the ratio of errors that is calculated by the equation, {the number p to count a mold shift even when the obtained data are within the allowable range/the number q to count the step of preventing a mold shift}, exceed the set value $q_0$, then the operation is shifted to the step of modifying the allowable range. The set number p0 is, for example, 5. The set value (the threshold) $q_0$ for the ratio of errors is, for example, 1%.

This embodiment has a step of estimating the cause of a mold shift during the operation of the flaskless molding line 100. By this configuration, the possibility of a mold shift can be reduced by taking appropriate measures. Further, it has a step of measuring the specific data at the position that may be a cause of a mold shift and a step of optimizing the allowable range to be used to determine if the specific data can be a cause of a mold shift. Thus, the cause of a mold shift can be definitely determined based on numerical data. Further, after the allowable ranges have been optimized, if a cause of a mold shift is found by using the allowable ranges, the operation to eliminate the cause is carried out. Thus, a mold shift can definitely be prevented. After the allowable ranges are determined to be optimized, they are checked to see if they are appropriate, while the operation is carried out. If the allowable range is determined not to be appropriate, the allowable range is again modified. Thus the allowable ranges are maintained to be appropriate.

The sequence of the steps that are above discussed can be arbitrarily changed. The allowable ranges that are above discussed are merely examples, and can be changed depending on the flaskless molding line.

The main reference numbers that are used in the specification and the drawings are listed below.

1 the cope
2 the drag
3 the device for detecting a mold shift
4, 5, 6 the means for measuring distances to the cope and the drag
7 the frame for moving up and down
100 the flaskless molding line
110 the plate for passing the mold
120 the cylinder for pushing out the mold
122 the pushing plate
124 the two-dimensional laser-type displacement sensor (the means for measuring fouling on the plate for receiving the mold, the means for measuring fouling on the plate for passing the mold, the means for measuring a difference between the level of the plate for receiving the mold and the level of the plate for passing the mold)
126 the means for measuring a waveform of the cylinder for pushing out a mold
128 the three-dimensional acceleration sensor (the means for measuring an impact on the pushing plate)
130 the encoder
140 the laser-type displacement sensor (the means for measuring a difference between the level of the plate for passing the mold and the level of the means for transporting the cope and the drag)
160 the device for blowing air
162 the air nozzles
200 the flaskless molding machine
210 the plate for receiving the mold
212 the three-dimensional acceleration sensor (the means for measuring an impact on the plate for receiving a mold)
214 the stopper bolt
218 the cylinder for the plate for receiving the mold (the actuator)
220 the lower squeeze board
222 the heater
224 the thermometer (the means for measuring the temperature of the lower squeeze board)

226 the two-dimensional laser-type displacement sensor (the means for measuring fouling on the lower squeeze board)
230 the cylinder for stripping the mold
232 the plate for pushing the mold
240 the lower flask
250 the upper flask
270 the device for automatically measuring the properties of the molding sand (the means for measuring the temperature of the molding sand)
272 the device for taking out the molding sand
280 the conveyor
290 the molding sand
300 the means for transporting the cope and the drag
310 the carriage with the molding board
312 the rollers
320 the rail
330 the scraper
332 the scraper for the groove
334 the scraper for the upper surface
336 the scraper for finishing
338 the touch-activated switch (the means for measuring fouling on the means for transporting the cope and the drag)
340 the lateral cylinder
342 the carriage
344 the bar for suspending the scrapers
350 the columns of a frame
352 the beam of a frame
360 the cleaning means
362 the scraper made of rubber
370 the rotating brush
372 the rotating shaft
374 the driver for rotating the rotating shaft (a motor)
380 the vertical frame
382 the horizontal frame
384 the frame for the scraper made of rubber
386 the stand
390 the pusher
391 the cushion
392 the traverser
400 the device for transferring the jacket and the weight
500 the shake-out machine
700 the controller
800 the pouring machine

The invention claimed is:

1. A method for reducing occurrences of a mold shift of a cope and a drag that have been molded by a flaskless molding machine and have been assembled, comprising:

a step of taking measurements to obtain specific data at positions where the mold shift may occur during a process for manufacturing or taking out the cope and the drag;

a step of determining if the obtained specific data are within an allowable range;

a step of determining if the mold shift of the cope and the drag has occurred; and a step of modifying the allowable range for the specific data based on the determination on an occurrence of the mold shift.

2. The method of claim 1, further comprising:

a step of preventing the mold shift by using the obtained specific data and the allowable range that has been modified by the step of modifying the allowable range.

3. The method of claim 2, wherein the step of modifying the allowable range or the step of preventing the mold shift is selectively carried out.

4. The method of claim 3, wherein shifting from the step of modifying the allowable range to the step of preventing the mold shift is carried out based on a number of operations of the step of modifying the allowable range, a number of non-occurrences of the mold shift, or a defect ratio that is a ratio of a number of occurrences of the mold shift to the number of operations of the step of modifying the allowable range.

5. The method of claim 3, wherein shifting from the step of preventing the mold shift to the step of modifying the allowable range is carried out based on a number of determinations finding that the mold shift has occurred in the step of determining if the mold shift has occurred although no cause for an occurrence of the mold shift exists in the step of preventing the mold shift, or based on a ratio of errors that is a ratio of a number of determinations finding that the mold shift has occurred in the step of determining if the mold shift has occurred although no cause for an occurrence of the mold shift exists in the step of preventing the mold shift to a number of operations of the step of preventing the mold shift.

6. The method of claim 1, wherein if the obtained specific data are determined to be outside the allowable range, an action to eliminate the cause of the mold shift is carried out.

7. The method of claim 1, wherein the process for manufacturing or taking out the cope and the drag comprises:

a step of filling molding sand in an upper flask and a lower flask;

a step of squeezing the molding sand that has been filled in the upper flask and the lower flask by an upper squeezing board and a lower squeezing board;

a step of pushing out the cope and the drag that have been squeezed from the upper flask and the lower flask to a plate for receiving the mold by means of a cylinder for stripping a mold; and a step of pushing out the cope and the drag on the plate for receiving the mold to a device configured to transport the cope and the drag by means of a cylinder for pushing out a mold, wherein the specific data are at least one kind of data on a size of fouling on the lower squeezing board, a difference between the temperature of the molding sand to be filled and the temperature of the lower squeezing board, a size of fouling on the plate for receiving the mold, an existence of fouling on the device configured to transport the cope and the drag, a waveform of a pressure or an electric current to drive the cylinder for pushing out the mold, an impact that is applied to a pushing plate by the cylinder for pushing out the mold, which pushes the cope and the drag, an impact that is applied to the plate for receiving the mold, a difference in levels of the plate for receiving the mold and the device configured to transport the cope and the drag, a time that has elapsed from a finishing of pouring to a shakeout, and an acceleration of the cylinder for pushing out the mold in a direction to push out the cope and the drag.

8. The method of claim 1, wherein the process for manufacturing or taking out the cope and the drag comprises:

a step of filling molding sand in an upper flask and a lower flask;

a step of squeezing the molding sand that has been filled in the upper flask and the lower flask by an upper squeezing board and a lower squeezing board;

a step of pushing out the cope and the drag that have been squeezed from the upper flask and the lower flask to a plate for receiving the mold by means of a cylinder for stripping a mold; and a step of pushing out the cope and the drag on the plate for receiving the mold to the plate for passing the mold by the cylinder for pushing out the mold and further to the device configured to transport the cope and the drag;

wherein the specific data are at least one kind of data on a size of fouling on the lower squeezing board, a difference between the temperature of the molding sand to be filled and the temperature of the lower squeezing board, a size of fouling on the plate for receiving the mold, a size of fouling on the plate for passing the mold, an existence of fouling on the device configured to transport the cope and the drag, a waveform of a pressure or an electric current to drive the cylinder for pushing out the mold, an impact that is applied to a pushing plate by the cylinder for pushing out the mold, which pushes the cope and the drag, an impact that is applied to the plate for receiving the mold, a difference between the level of the plate for receiving the mold and the level of the plate for passing the mold, a difference between the level of the plate for passing the mold and the level of the the device configured to transport the cope and the drag, a time that elapses from a finishing of pouring to a shake-out, and an acceleration of the cylinder for pushing out the mold in a direction to push out the cope and the drag.

9. A flaskless molding line comprising:

a flaskless molding machine that molds a cope and a drag by filling molding sand in an upper flask and a lower flask and squeezing it by means of an upper squeezing board and a lower squeezing board and that pushes out the cope and the drag that have been assembled from the upper flask and the lower flask onto the plate for receiving the mold;

a device configured to transport the cope and the drag from the flaskless molding machine to a shake-out machine via a position where molten metal is poured into the cope and the drag from a pouring machine;

a cylinder for pushing out the mold that pushes out the cope and the drag on the plate for receiving the mold to the device configured to transport the cope and the drag;

a sensor that measures specific data at positions where a mold shift may occur during a process for manufacturing or taking out the cope and the drag;

a controller that stores data on an allowable range for the specific data that are obtained and that determines if the obtained specific data are within the allowable range; and a device for detecting the mold shift that detects the mold shift of the cope and the drag, wherein the controller determines if the mold shift has occurred, wherein the controller modifies the allowable range for the specific data based on the determination on an occurrence of the mold shift.

10. The flaskless molding line of claim 9, wherein the controller causes the step of preventing the mold shift to be implemented by using the obtained specific data and the allowable range that has been modified.

11. The flaskless molding line of claim 9, wherein the sensor is at least one of a sensor for fouling on the lower squeezing board that measures a size of fouling on the lower squeezing board; a sensor configured to measure the temperature of the molding sand that measures the temperature of the molding sand to be filled and a sensor configured to measure the temperature of the lower squeezing board; a sensor configured to measure fouling on the plate for receiving the mold that measures the a size of fouling on the plate for receiving the mold; a sensor configured to measure fouling on the device configured to transport the cope and the drag that measures an existence of fouling on the device configured to transport the cope and the drag; a sensor configured to measure a waveform of the cylinder for pushing out a mold that measures the waveform of the pressure or the electric current that drives the cylinder for pushing out the mold; a sensor configured to measure an impact on the pushing plate that measures an impact applied to the pushing plate of the cylinder for pushing out the mold that pushes the cope and the drag; and a sensor configured to measure an impact on the plate for receiving a mold.

12. The flaskless molding line of claim 11 further comprising:

a plate for passing the mold that is a path for transporting the cope and the drag between the plate for receiving the mold and the device configured to transport the cope and the drag; and as the sensor, a sensor configured to measure fouling on the plate for passing the mold that measures a size of fouling on the plate for passing the mold, or a sensor configured to measure a difference between the level of the plate for receiving the mold and the level of the plate for passing the mold, or a sensor configured to measure a difference between the level of the plate for passing the mold and the level of the device configured to transport the cope and the drag.

* * * * *